United States Patent [19]

Ikeda et al.

[11] Patent Number: 4,943,800

[45] Date of Patent: Jul. 24, 1990

[54] INTRUSION DETECTION SYSTEM USING THREE PYROELECTRIC SENSORS

[75] Inventors: Masami Ikeda, Higashi; Yasuhiro Yamada, Neyagawa; Mahito Tuji, Yahata; Akimasa Tamano, Osaka; Yasunari Mizoguchi, Sumoto, all of Japan

[73] Assignee: Sanyo Electric Co., Ltd., Osaka, Japan

[21] Appl. No.: 207,983

[22] Filed: Jun. 17, 1988

[30] Foreign Application Priority Data

Jun. 19, 1987 [JP] Japan ..... 62-153766
Sep. 16, 1987 [JP] Japan ..... 62-231570
Sep. 18, 1987 [JP] Japan ..... 62-143448

[51] Int. Cl.[5] ..... G08B 13/18

[52] U.S. Cl. ..... 340/567; 250/340; 250/395

[58] Field of Search ..... 340/567; 250/338.3, 250/340, 371, 395

[56] References Cited

U.S. PATENT DOCUMENTS 3,453,432 7/1969 McHenry ..... 250/338.3
3,524,180 8/1970 Cruse ..... 340/567
4,614,938 9/1986 Weitman ..... 340/567
4,745,284 5/1988 Masuda et al. ..... 250/338.3
4,799,243 1/1989 Zepke ..... 250/338.3
4,800,368 1/1989 Wisner ..... 340/567

FOREIGN PATENT DOCUMENTS 0198551 10/1986 European Pat. Off. .
0224595 6/1987 European Pat. Off. .
0235372 9/1987 European Pat. Off. .
61-30180 9/1986 Japan .

*Primary Examiner*—Glen R. Swann, III
*Attorney, Agent, or Firm*—Armstrong, Nikaido, Marmelstein, Kubovcik & Murray

[57] ABSTRACT

The intrusion detection system of the invention, in which three pyroelectric detectors are disposed in line with a interval and an adjoining two of the three pyroelectric detectors are electrically connected to cancel electrical charges generated by each pyroelectric detector, detects intrusion of an infrared ray radiating object such as a human body for example by output signals outputted from the adjoining two and the other of the three pyroelectric detectors or by output signals outputted from the pyroelectric detector disposed at the center and adjoining one and output signals outputted from the one disposed at the center and adjoining another one of these pyroelectric detectors, so that precise and secure intrusion detection is possible by reducing erroneous signals generated by those pyroelectric detectors due to variation of the atmospheric temperature and the like.

11 Claims, 23 Drawing Sheets

Fig. 15

| | | VARIATION RANGE (V) |
|---|---|---|
| CONVENTIONAL SENSOR | 1st SIGNAL | 0.4 |
| | 2nd SIGNAL | 1.0 |
| THIS INVENTION SENSOR | 1st SIGNAL | 0.4 |
| | 2nd SIGNAL | 0.4 |

Fig. 16

| | | OUTPUT VOLTAGE (RATIO) |
|---|---|---|
| CONVENTIONAL SENSOR | 1st SIGNAL | 1.0 |
| | 2nd SIGNAL | 0.9 |
| THIS INVENTION SENSOR | 1st SIGNAL | 1.8 |
| | 2nd SIGNAL | 1.8 |

Fig. 20

| A | B | CD | Q $\overline{Q}$ |
|---|---|---|---|
| L | ↓ | H | ⊓ ⊔ |
| ※ | L | H | INHIBIT |
| ↑ | H | H | ⊓ ⊔ |
| H | ※ | H | INHIBIT |
| ※ | ※ | L | INHIBIT |

※ : both H and L are permitted.

INTRUSION DETECTION SYSTEM USING THREE PYROELECTRIC SENSORS

BACKGROUND OF THE INVENTION

1. Field of the Invention

This invention relates to an intrusion detection system which detects a human body as an infrared ray radiating object by means of pyroelectric infrared sensor incorporating a plurality of pyroelectric detectors, and identifies the intrusion of a visitor or an intruder.

2. Description of the Prior Art

Conventionally, there are a variety of intrusion detection systems which are widely made available by conventional stores and individual homes for detecting and alarming of visitation or intrusion of any person. Normally, most of these conventional intrusion detection systems use pyroelectric infrared sensors incorporating pyroelectric detectors for detecting an approaching or moving human body as the infrared ray radiating object.

Any conventional pyroelectric infrared sensor outputs a detection signal in response to varied infrared ray energy incident upon itself. For example, recently, there are a wide variety of alarms against intrusion or systems for advising store employees of visiting buyers which detect visitation or intrusion of any person via the pyroelectric infrared sensor using infrared rays radiated from the human body. However, since any of those conventional pyroelectric infrared sensors output a detected signal only at the moment when the quantity of incident infrared energy varies, it merely detects the human body intruding himself into the surveillance region or leaving it, and thus, it cannot correctly identify the direction of the movement of the detected human body. In other words, it cannot correctly identify whether he is still on the way of intrusion or leaving the surveillance region.

Nevertheless, in order to gain information in conjunction with the direction of the movement of the human body, any conventional pyroelectric infrared sensor can also identify the direction of the movement of human body by identifying which one of the two pyroelectric infrared sensors first outputs detect-signals. Nevertheless, this conventional system needs the provision of two optical units, and yet, this also needs installation of more expanded and complex facilities, thus eventually resulting in increased cost.

To eliminate those problems mentioned above, Japanese Utility Model Publication No. 61-30180 (1986) proposes a constitution of pyroelectric infrared sensors, the detail of which is shown in FIGS. 1 and 2.

A pair of pyroelectric detectors 91 and 92 are installed in the vertical direction, while each of these pyroelectric detectors is provided with electrodes **91*b* and 92*b* without overlapping each other. The remaining portions 91*a* and 92*a* outside of electrodes 91*b* and 92*b* respectively allow permeation of infrared rays. This allows each of these electrodes 91*b* and 92*b* to independently output a specific amount of voltage and thus detect the direction of the movement of a human body by comparing voltages output from those pyroelectric detectors. On the other hand, the above constitution causes each of these pyroelectric detectors 91 and 92 to sensitively react to atmospheric temperature, and as a result, these pyroelectric detectors 91 and 92** often generate incorrect detection signals other than normal ones.

Conventionally, in order to prevent any of those incorrect signals from being generated, a pair of pyroelectric detectors are connected to each other in parallel or in series to constitute dual-elements so that the polarity of these elements can be opposite from each other, thus effectively offsetting any of those incorrectly generated detection signals caused by variable atmospheric temperature. Consequently, the dual-element constitution of the pyroelectric detector proposed by the above-cited prior art can prevent incorrect detection signals from being generated. On the other hand, since this constitution needs to employ 4 pyroelectric detectors which are aligned with each other at a certain interval in a casing, it in turn obliges manufacturers to design greater-size sensors and a more complex constitution of the sensor, thus eventually incurring costwise disadvantage.

On the other hand, some of conventional incoming visitor announcing systems introduced to stores identify the direction of the movement of people passing by path and generate audio messages such as "welcome your visit to us" for those who are entering into stores and "thank you for your shopping made with us" for those who are leaving stores for example. However, it is quite important for those stores to have the incoming visitor announcing system securely identify incoming visitors and advise store employees of actual visitors entering the stores.

SUMMARY OF THE INVENTION

The primary object of the present invention is to overcome those problems mentioned above by providing a novel intrusion detection system which fully eliminates a variety of problems caused by frequent occurrence of incorrect signals generated by pyroelectric detectors, enlargement of the dimensions and complication of infrared sensors incorporating pyroelectric detectors, and yet, being capable of securely and accurately detecting the moving direction of intruding human bodies.

Another object of the invention is to provide a novel intrusion detection system which is capable of securely identifying the movement of a human body as the object to be detected in a predetermined direction.

The intrusion detection system of the invention is provided with the following: three pyroelectric detectors each having a pair of electrodes, which are aligned in line at a interval respectively, and two adjoining detectors are electrically connected so that the electrical charge genarated by each of them is canceled, wherein the first embodiment executes detection of a human body in response to the first signal output from two of the adjoining three pyroelectric detectors and also in response to the second signal output from the other one among the three pyroelectric detectors. The second embodiment also executes detection of a human body in accordance with the first signal output from the two pyroelectric detectors including the one disposed at the center and the adjoining one being connected to each other in series and also in accordance with the second signal output from the two pyroelectric detectors including the one disposed at center and the other adjoining one being connected to each other in series.

By virtue of the novel constitution mentioned above, when implementing the first embodiment, even if the second signal based on the detection signal output from a pyroelectric detector may generate incorrect content by adversely being affected by atmospheric temperature, since the first signal based on the detection signals output from two pyroelectric detectors rarely generates incorrect signals, the intrusion detection system of the first embodiment rarely malfunctions in identifying the object to be detected. On the other hand, when implementing the second embodiment, since the pyroelectric detectors on both sides share the center pyroelectric detector unit in order that each of these three pyroelectric detectors can output signals for detecting any intruding human body using the first and second signals based on the above system, the intrusion detection system related to the present invention fully prevents even the slightest possibility of incorrect identification of the object from occurring.

The above and further objects and features of the invention will more fully be apparent from the following detailed description with accompanying drawings.

BRIEF DESCRIPTION OF THE DRAWINGS

FIG. 15 is a table denoting the actual result of the measurement of variation range of output voltage relative to variable atmospheric temperature between a conventional pyroelectric infrared sensor and the one of the invention, FIG. 16 is a table denoting the actual result of the measurement of the output voltage of a conventional pyroelectric infrared sensor and the one of the invention, FIG. 20 is a truth value table of the mono-multivibrator in the circuit diagram shown in FIG. 19.

DESCRIPTION OF THE PREFERRED EMBODIMENTS

Referring now more particularly to the accompanying drawings, preferred embodiments of an intrusion detection system related to this invention are described below.

Figure 1:
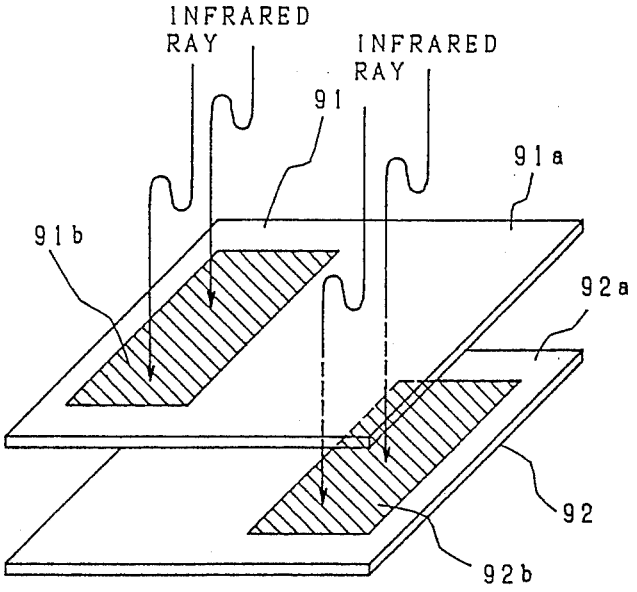
Fig. 1 Prior Art
FIG. 1 is the schematic diagram of pyroelectric detectors of a conventional pyroelectric infrared sensor.
Figure 2:
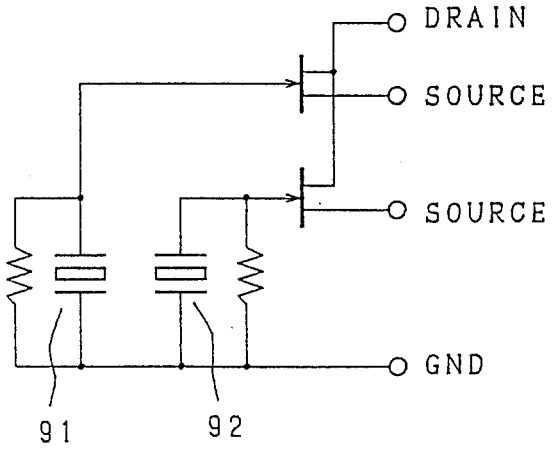
Fig. 2 Prior Art
FIG. 2 is the simplified circuit diagram denoting electrical connections of the conventional pyroelectric detectors shown in FIG. 1.
Figure 3:
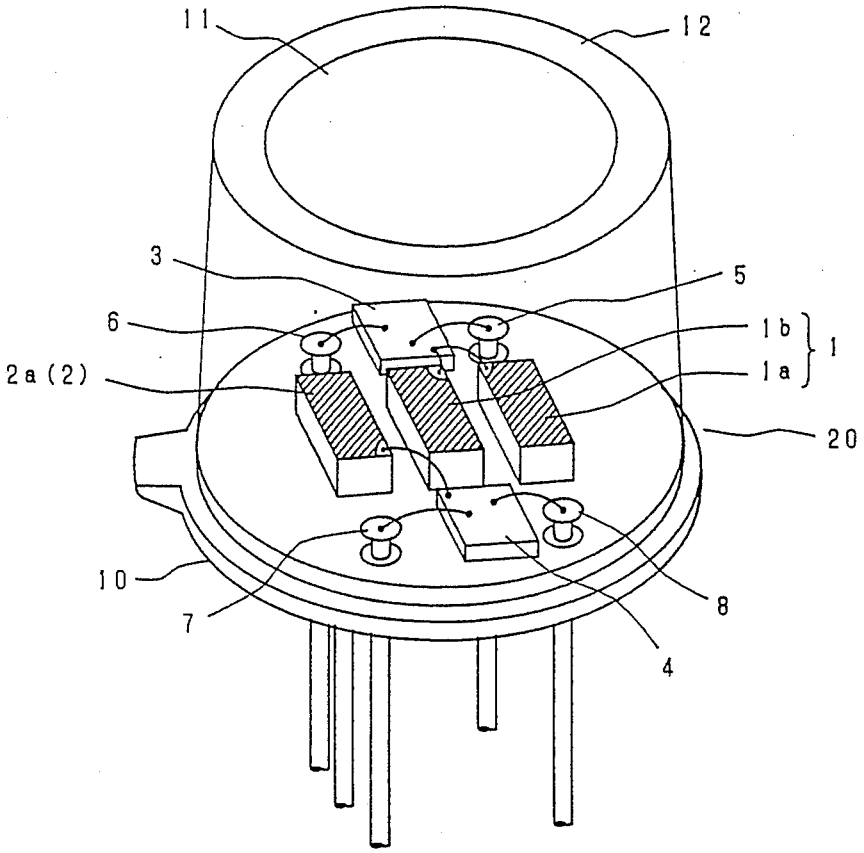
FIG. 3 is a perspective view denoting an example of the constitution of the pyroelectric infrared sensor embodied by the first embodiment of the intrusion detection system of the invention.
Figure 4:
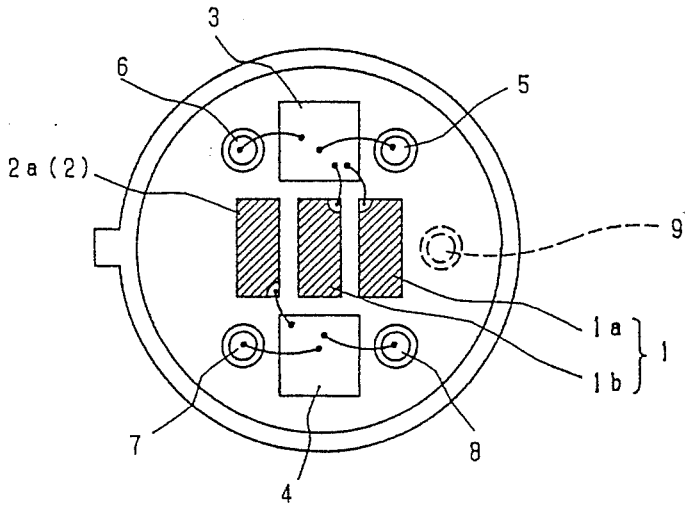
FIG. 4 is a plan view denoting the internal constitution of the pyroelectric infrared sensor shown in FIG. 3.
Figure 5:
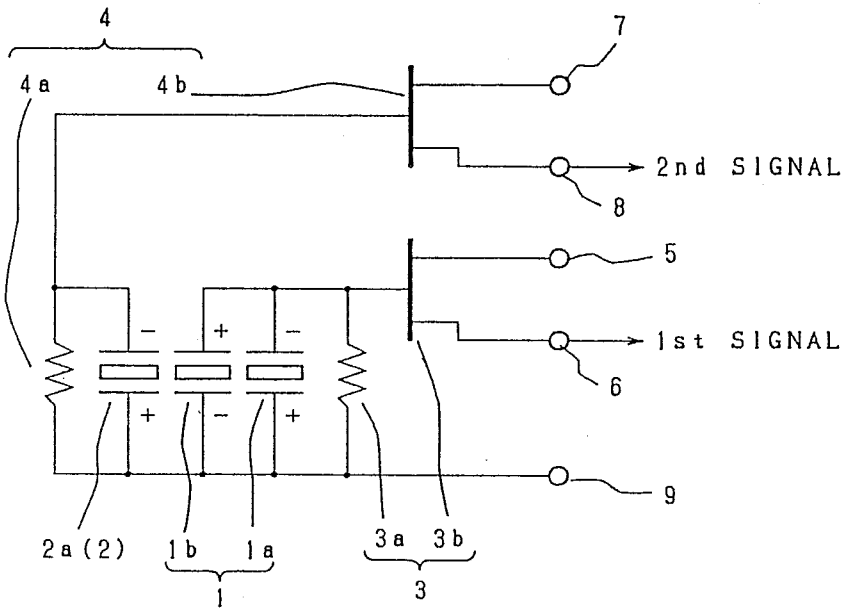
FIG. 5 is a simplified circuit diagram denoting the electrical connections of the pyroelectric infrared sensor shown in FIG. 3, FIG. 6 (*a*) is a schematic block diagram of the signal processing circuit for the human body detection system of the invention, FIG. 6 (*b*) is a chart denoting waveforms when the human body moves in the first direction, FIG. 6 (*c*) is a chart denoting waveforms when the human body moves in the second direction.

FIG. 3 is the perspective view of the pyroelectric infrared sensor of a preferred embodiment of the first embodiment of the intrusion detection system related to the invention. FIG. 4 is the plan view denoting the internal constitution of the pyroelectric infrared sensor shown in FIG. 3. FIG. 5 is the simplified circuit diagram denoting the electrical connections of the pyroelectric infrared sensor shown in FIG. 3.

First, constitution of the pyroelectric infrared sensor 20 is described below.

Pyroelectric detectors 1*a* and 1*b* are respectively provided with about 50 microns of thickness and made from crystals of lithium tantalite ($LiTaO_3$) generating charge according to varied quantity of infrared rays incident thereto. Both of pyroelectric detectors 1*a* and 1*b* are provided with electrodes on the front and back surfaces, which are respectively polarized as shown in FIG. 5 in order that the polarity of these can be opposite from each other. The pyroelectric detectors 1*a* and 1*b* constitute an element 1 by being connected in parallel with each other and this element 1 outputs the first signal. On the other hand, a pyroelectric detector 2*a* alone constitutes an element 2 which outputs the second signal.

A register 3*a* having $10^8$ through $10^{11}\Omega$ of resistance value and an FET 3*b* constitute an impedance conversion thick-film circuit 3 for extracting a signal output from the element 1. A resistor 4*a* having $10^8$ through $10^{11}\Omega$ of resistance value and an FET 4*b* also constitute an impedance conversion thick-film circuit 4 for extracting a signal output from the element 2.

These elements 1 and 2 and the impedance conversion thick-film circuits 3 and 4 are installed on a header 10. Terminals 5 and 7 respectively feed voltages to the impedance conversion thick-film circuits 3 and 4, while terminals 6 and 8 respectively output signals. All of these terminals 5 through 8 are externally insulated from the header 10. A ground terminal 9 is electrically connected to the header 10. A cylindrical can 12 having an outer diameter 10 mm and an infrared-ray permeable window 11 are respectively secured to the header 10, while the interior of this can 12 is air-tightly sealed.

As shown in FIG. 4, 3 pyroelectric detectors 1*a*, 1*b* and 2*a* are respectively installed on the header 10 in line with intervals of 0.2 through 1.0 mm. The pyroelectric detectors 1*a* and 1*b* are respectively polarized in inverse polarity and also the pyroelectric detectors 1*b* and 2*a* are respectively polarized in inverse polarity. In other words, pyroelectric detectors 1*a* and 2*a* are of the identical polarity, whereas pyroelectric detector 1*b* is polarized so that the polarity is opposite from those of 1*a* and 2*a*. As shown in FIG. 5, a signal output from the element 1 composed of pyroelectric detectors 1*a* and 1*b* is extracted as a first signal from the terminal 6 via the impedance-conversion thick-film circuit 3. A signal output from the element 2 composed of pyroelectric detector 2*a* is extracted as a second signal from the terminal 8 via the impedance-conversion thick-film circuit 4.

Figure 6A:
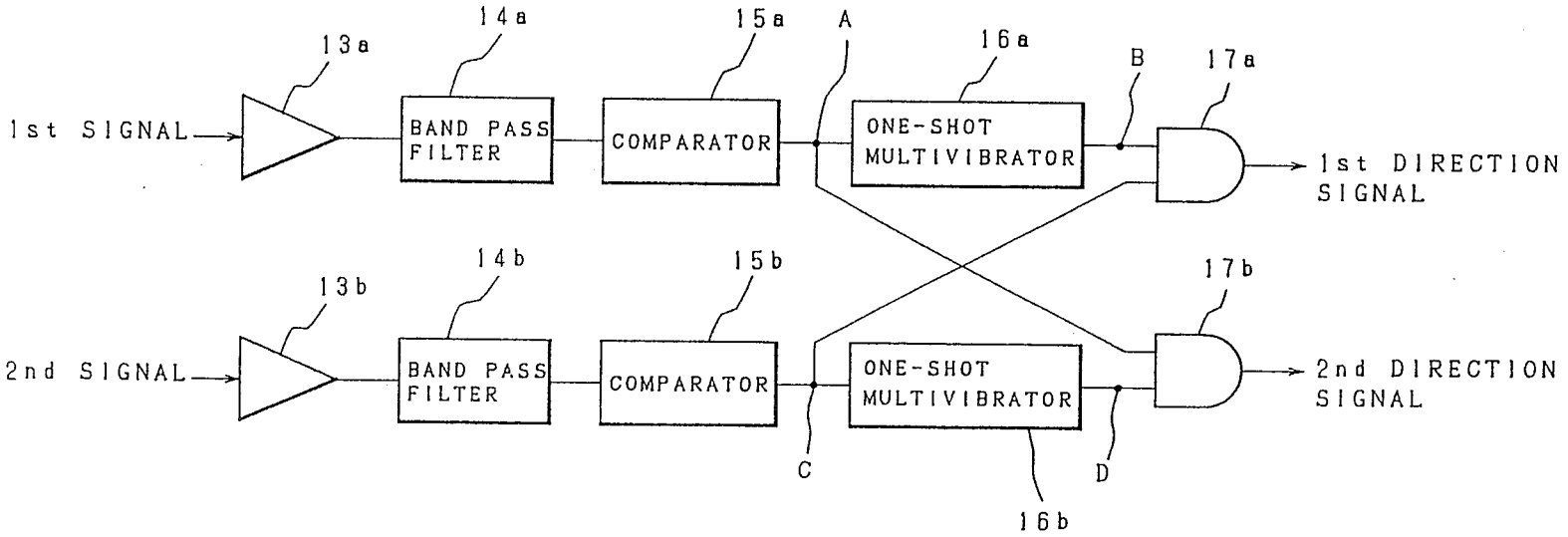
Figure 6B:
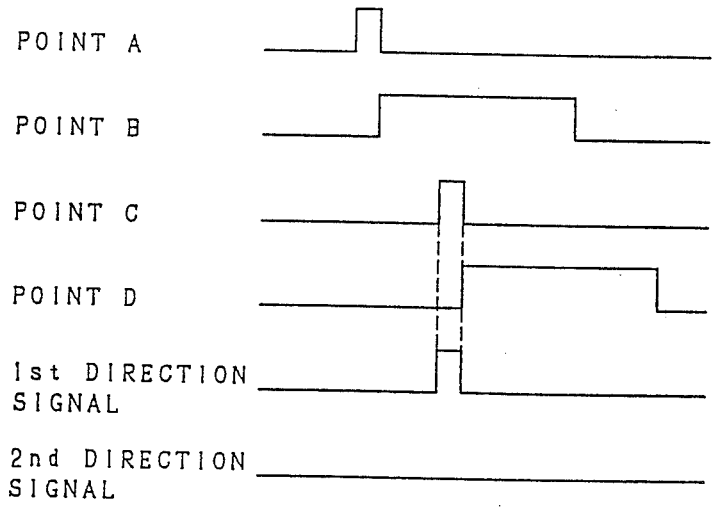
Figure 6C:
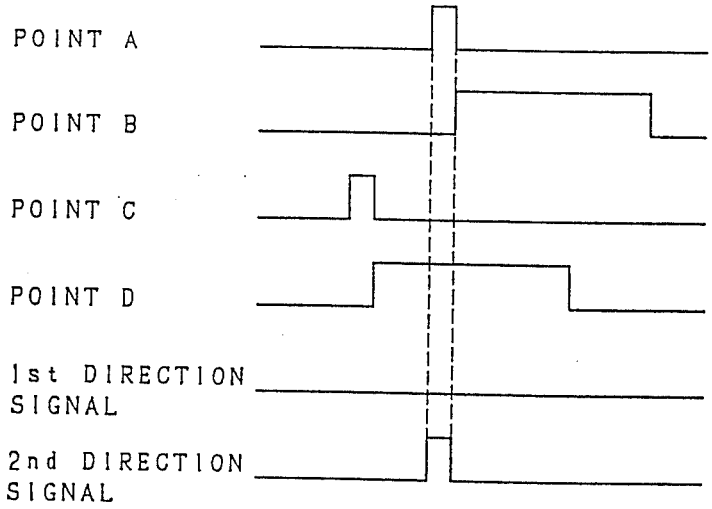

FIG. 6 (*a*) is a schematic block diagram of the circuit for processing the first and second signals.

Amplifiers 13*a* and 13*b* are provided with 50 through 90 dB of gain respectively. Band-pass filters 14*a* and 14*b* filter 0.5 through 20 Hz of low-band frequencies and selectively pick up signals in conjunction with the movement of the human body respectively. Comparators 15*a* and 15*b* compare the predetermined threshold value (such as 1 V for example) and the input signals and output only those signals which are greater than the threshold value respectively. One-shot multivibrators 16*a* and 16*b* are provided with an adequate pulse width such as 1 second for example. The AND gates 17*a* and 17*b* are also provided. AND gate 17*a* receives the first signal via one-shot multivibrator 16*a*, while it also receives the second signal via comparator 15*b*. The AND gate 17*b* also receives the first signal via comparator 15*a* and the second signal via one-shot multivibrator 16*b*.

Next, the operation of the intrusion detection system related to the first embodiment of the invention by installing pyroelectric infrared sensor 20 shown in FIG. 7 when detecting the movement of a human body HB using the signal processing circuit shown in FIG. 6 (*a*) is described below.

Figure 7:
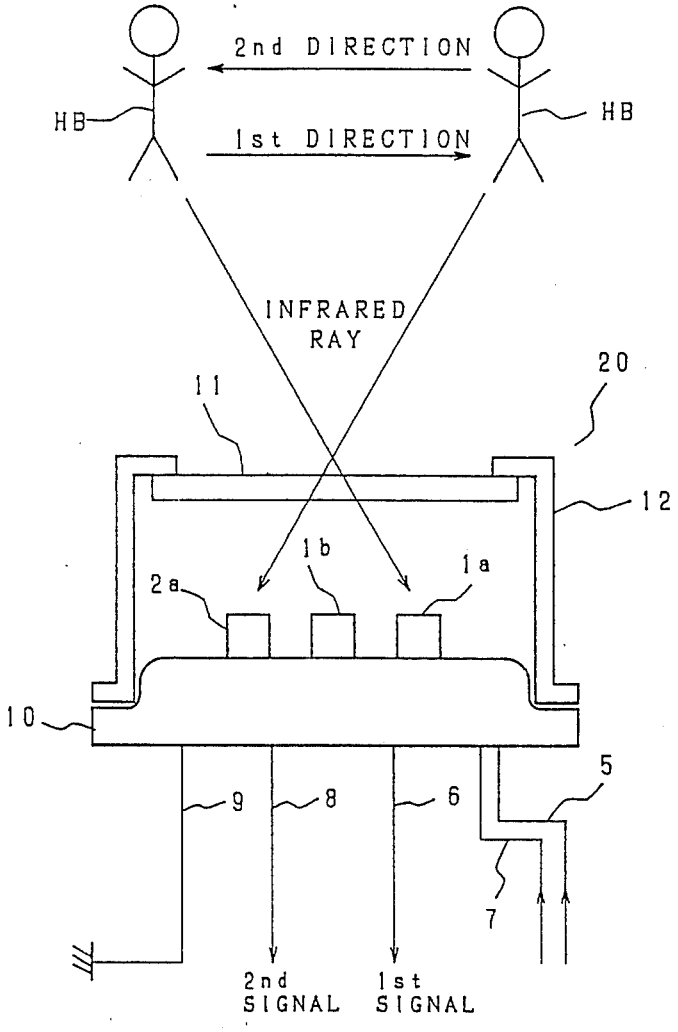
FIG. 7 is a schematic diagram denoting the positional relationship between the pyroelectric infrared sensor of the invention and the human body to be detected, FIG. 8 (*a*) is a schematic diagram denoting the another signal processing circuits for a preferred embodiment of the pyroelectric infrared sensor of the invention, FIG. 8 (*b*) is a chart denoting waveforms when the human body moves in the first direction, FIG. 8 (*c*) is a chart denoting waveforms when the human body moves in the second direction.

When the human body HB moves in the first direction shown in FIG. 7 (from the left side to the right side), first, infrared rays radiated from the human body from a great distance merely enter into the pyroelectric detector 1*a*, and then, infrared rays also enter into pyroelectric detector 1*b* and finally 2*a* before eventually entering into all of those three pyroelectric detectors.

As a result, the first signal output from the terminal 6 is output as a signal shown in FIG. 6 (*b*) through the amplifier 13*a*, band-pass filter 14*a*, and comparator 15*a* (at point A). This causes the one-shot multivibrator 16*a* to hold H-level output signal for a predetermined duration (at point B).

Next, as the human body HB proceeds in the first direction, infrared rays enter into pyroelectric detector 2*a* to allow the second signal from terminal 8 to be output as a signal shown in FIG. 6 (*b*) through the amplifier 13*b*, band-pass filter 14*b*, and comparator 15*b* (at point C). This causes the one-shot multivibrator 16*b* to hold H-level output signal for a predetermined duration (at point D).

Since the AND gate 17*a* receives those signals output at points B and C, it generates a first direction signal which has detected the movement of the human body HB in the first direction. On the other hand, since the AND gate 17*b* receives those signals output from points A and D, it does not output a second direction signal.

When the human body HB moves in the second direction shown in FIG. 7, infrared rays radiated from the human body HB from a great distance enter into only pyroelectric detector 2*a*, and then into the pyroelectric detector 1*b*, and finally into the pyroelectric detector 1*a* so that all of these three pyroelectric detectors 2*a*, 1*b* and 1*a* can eventually receive infrared rays from the human body HB.

As a result, the second signal output from the terminal 8 is output as a signal shown in FIG. 6 (*c*) through the amplifier 13*b*, band-pass filter 14*b*, and comparator 15*b* (at point C). This causes the one-shot multivibrator 16*b* to hold H-level output signal for a predetermined duration (at point D).

Next, as the human body HB proceeds in the second direction, infrared rays enter into the pyroelectric detectors 1*b* and 1*a* to allow the first signal from the terminal 6 to be output as the signal shown in FIG. 6 (*c*) through the amplifier 13*a*, band-pass filter 14*a*, and comparator 15*a* (at point A). This causes the one-shot multivibrator 16*a* to hold H-level output signal for a predetermined duration (at point B).

Since the AND gate 17*b* receives those signals outputted at the points A and D in the manner mentioned above, it generates the second direction signal which has detected the movement of the human body HB in the second direction. On the other hand, since the AND gate 17*a* receives those signals output from the points B and C, it does not output the first directional signal.

In this way, when the human body HB moves in the first direction, first, the first signal is generated, followed by the second signal, and as a result, the first directional signal is generated to detect the movement of the human body HB in the first direction. Conversely, when the human body HB moves in the second direction, first, the second signal is generated, followed by the first signal, and as a result, the second directional signal is generated to detect the movement of the human body HB in the second direction.

Figure 8A:
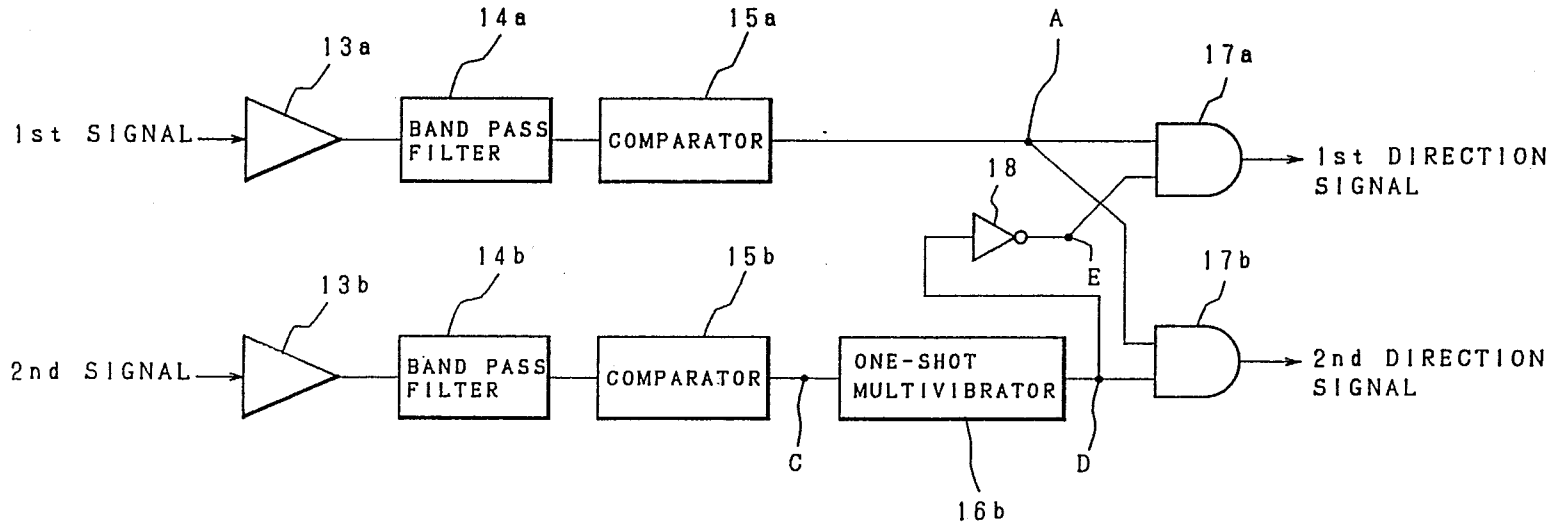
Figure 8B:
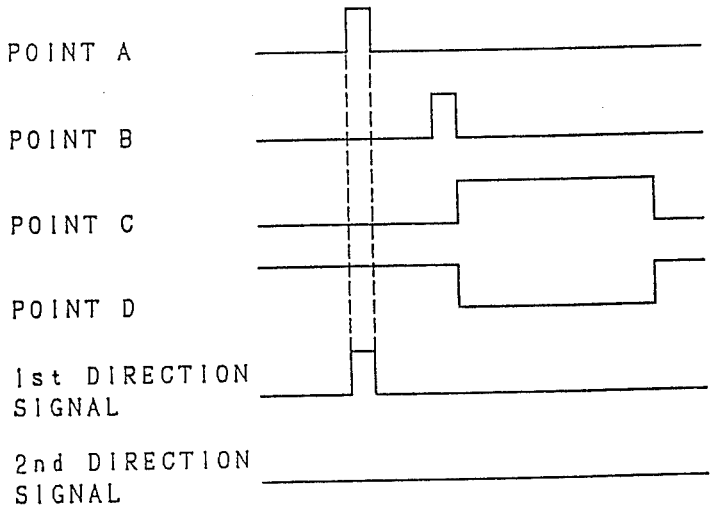
Figure 8C:
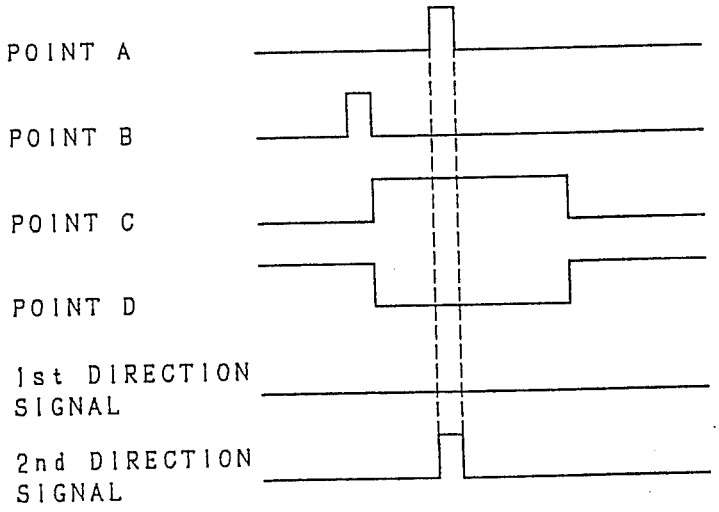

FIG. 8 (*a*) is a schematic block diagram of another preferred embodiment of the signal processing circuit used in the intrusion detection system related to the invention. Those elements identical to those which are shown in FIG. 6 (*a*) are provided with identical reference numerals, and thus the description of these is deleted. In FIG. 8 (*a*), numeral 18 designates an inverter. The second signal is delivered to the inverter 18 via the one-shot multivibrator 16*b*, and then, the signal output from inverter 18 is delivered to the AND gate 17*a*.

When human body HB moves in the first direction shown in FIG. 7, the first signal output from the terminal 6 is output as a signal shown in FIG. 8 (*b*) through the amplifier 13*a*, band-pass filter 14*a*, and comparator 15*a* (at point A). Next, as the human body HB proceeds in the first direction, the second signal output from the tèrminal 8 is output as a signal shown in FIG. 8 (*b*) through the amplifier 13*b*, band-pass filter 14*b*, and comparator 15*b* (at point C). This causes the one-shot multivibrator 16*b* to hold H-level output signal for a predetermined duration (at point D). Then, the inverter 18 inverts the H-level output signal (at point E).

In this way, since the AND gate 17*a* receives those signals generated at the point A and E, it generates the first direction signal which has detected the movement of the human body HB in the first direction. On the other hand, since the AND gate 17*b* receives signals output at the points A and D, it does not generate the second directional signal.

When the human body HB moves in the second direction shown in FIG. 7, the second signal output from the terminal 8 is output as the signal shown in FIG. 8 (*c*) through amplifier 13*b*, band-pass filter 14*b*, and comparator 15*b* (at point C). This causes the one-shot multivibrator 16*b* to hold H-level signal for a predetermined duration (at point D). The inverter 18 then inverts this output signal (at point E). Next, as the human body HB proceeds in the second direction, the first signal output from the terminal 6 is output as the signal shown in FIG. 8 (*c*) through amplifier 13*a*, band-pass filter 14*a*, and comparator 15*a* (at point A).

In this way, since the AND gate 17*a* receives those signals generated at the points A and E, it does not output the first direction signal. On the other hand, since the AND gate 17*b* receives those signals generated at the points A and D, it generates the first direction signal which has detected the movement of the human body HB in the first direction.

When the human body HB moves in the first direction, the signal-processing circuit shown in FIG. 8 (*a*) first generates the first signal, and then the second signal is generated, thus causing the first direction signal to be generated before eventually allowing this signal to detect the movement of human body in the first direction. When the human body HB moves in the second direction, first, the second signal is generated, and then, the first signal is generated, thus causing the second direction signal to be generated before eventually allowing this signal to detect the movement of the human body HB in the second direction. In other words, by sequential order of generating the first and second signals, the pyroelectric infrared sensor related to the invention correctly detects the direction of the movement of the human body.

It should be understood, however, that, of the pyroelectric infrared sensor 20 used in the intrusion detection system related to the invention, compared to the element 1 composed of two pyroelectric detectors 1*a* and 1*b* which are provided with inverse polarity to one another and connected to each other in parallel and outputs the first signal, the element 2 composed of only one pyroelectric detector 2*a* and outputting the second signal is unstably vulnerable to external disturbance like variable atmospheric temperature. In particular, if atmospheric temperature suddenly varies, the pyroelectric detector 2*a* may suddenly stop the operation for outputting the second signal to eventually cause the entire detecting operation to become impossible.

Although the charge generated in these pyroelectric detectors by effect of external disturbance can properly be offset by internal compensating function provided by an inverse polarity of the pyroelectric detectors 1*a* and 1*b* which constitute the element 1 outputting the first signal, since the element 2 which outputs the second signal is composed of the pyroelectric detector 2*a* alone, no internal compensating function can be provided, and as a result, the charge generated in pyroelectric detector 2*a* is externally output as it is, thus eventually causing the pyroelectric detector 2*a* to suddenly stop the delivery of the second signal and making it impossible for the entire system to follow up the detecting operation any more.

Now, in order to fully solve those problems mentioned above, the second embodiment of this invention is implemented, the detail of which is described below.

Figure 9:
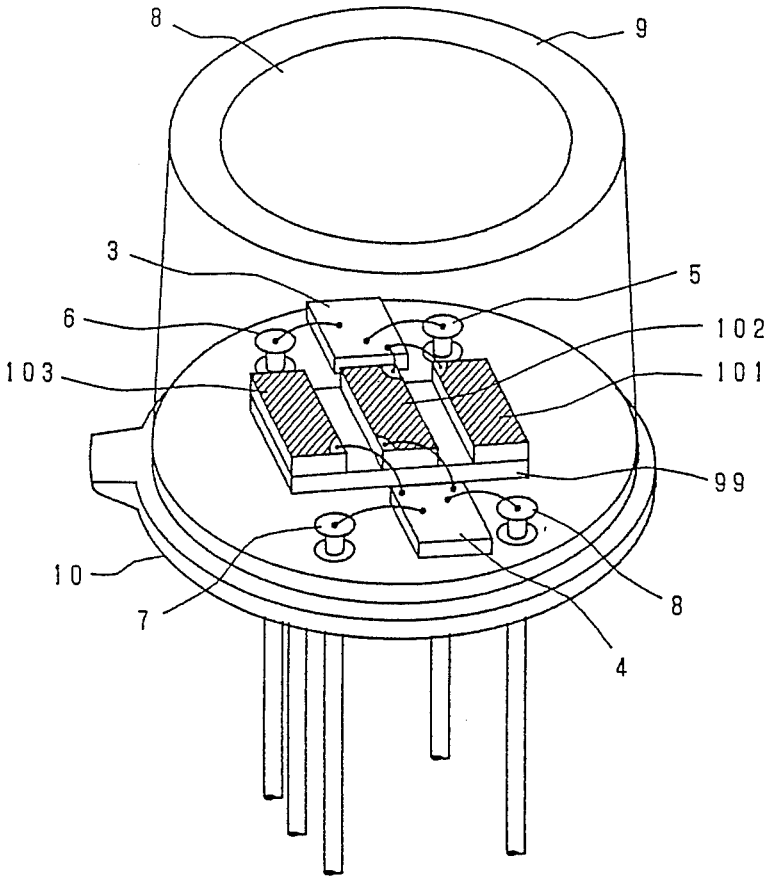
FIG. 9 is a perspective view denoting an example of the constitution of the pyroelectric infrared sensor embodied by the second embodiment of the intrusion detection system related to the invention.
Figure 10:
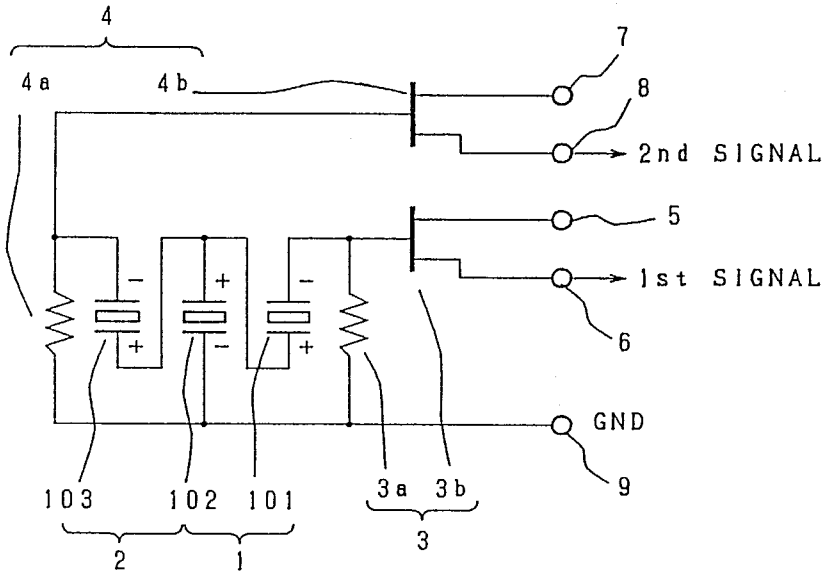
FIG. 10 is a simplified circuit diagram denoting the electrical connection of the pyroelectric infrared sensor shown in FIG. 9.

FIG. 9 is a perspective view of an example of the constitution of the pyroelectric infrared sensor of the second embodiment in conjunction with the intrusion detection system related to the invention. FIG. 10 is the simplified circuit diagram denoting the electrical connection of the pyroelectric infrared sensor shown in FIG. 9. Those elements identical or corresponding to those which are used in the first embodiment are provided with identical reference numerals.

Pyroelectric detectors 101 through 103 shown in FIGS. 9 and 10 are of the constitution identical to those which are cited in the foregoing description. In the second embodiment, the element 1 which outputs the first signal is composed of the first pyroelectric detector 101 and the second pyroelectric detector 102, whereas the element 2 which outputs the second signal is composed of the second pyroelectric detector 102 and the third pyroelectric detector 103. The surface area of the first pyroelectric detector 101 is almost equivalent to that of the third pyroelectric detector 103, whereas the surface area of the second pyroelectric detector 102 is equal to those of the first and the third pyroelectric detectors 101 and 103 or doubles the surface of each of these.

The first pyroelectric detector 101 and the second pyroelectric detector 102 have inverse polarity and connected to each other in series, while each of these is also connected to impedance-conversion circuit 3 composed of a resistor 3*a* and an FET 3*b* and also to the grounding terminal 9. Likewise, the third pyroelectric detector 103 and the second pyroelectric detector 102 also have inverse polarity and are connected to impedance-conversion circuit 4 composed of a resistor 4*a* and an FET 4*b* and also to the grounding terminal 9. Accordingly, the first pyroelectric detector 101 and the third pyroelectric detector 103 are of the identical polarity and are connected to each other in parallel, and thus, both of these pyroelectric detectors 101 and 103 share the second pyroelectric detector 102.

Each of these pyroelectric detectors 101 through 103 is securely installed on the header 10 across electrical insulator 99.

Figure 11:
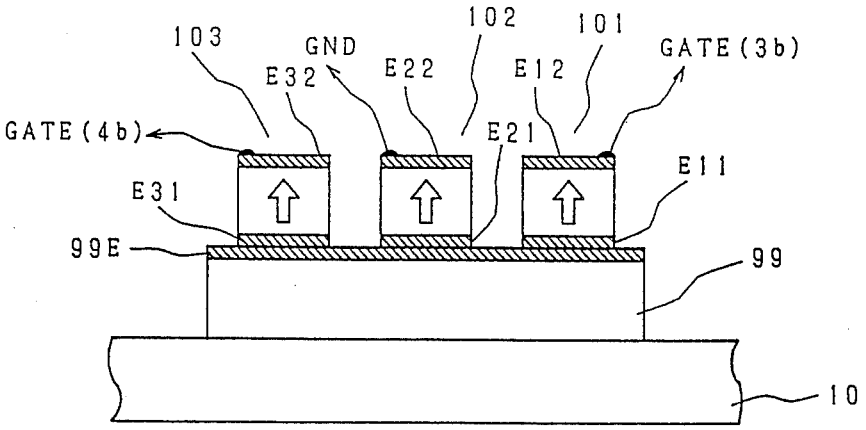
FIG. 11 is a side view denoting an example of the constitution of the pyroelectric infrared sensor shown in FIG. 9.

FIG. 11 is a schematic side view of the assembled unit of these pyroelectric detectors 101 through 103 and the electrical insulator 99. An electrode 99E is provided on the insulator 99 being on the opposite side from header 10, while each of these pyroelectric detectors 101 through 103 is independently installed on the upper surface of the electrical insulator 99. Each one of electrodes E11, E21 and E31 of these pyroelectric detectors 101 through 103 contact the electrode 99E on the insulator 99 so that these electrodes E11, E21 and E31 are electrically connected to each other. Another electrode E12 of the first pyroelectric detector 101 is connected to a gate of the FET **3*b* of the impedance-conversion circuit 3. Another electrode E22 of the second pyroelectric detector 102 is connected to the ground terminal 9. Another electrode E32 of the third pyroelectric detector 103 is connected to a gate of the FET 4*b* of the impedance-conversion circuit 4. These component elements integrally constitute the circuit shown in FIG. 11. Arrows shown in FIG. 11** respectively denote the polarizing directions.

Figure 12:
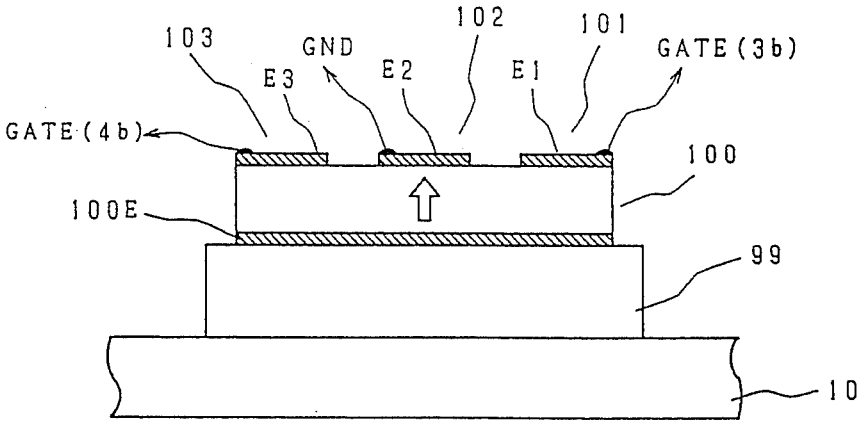
FIG. 12 is a side view denoting another example of the constitution of the pyroelectric infrared sensor of the the invention.

FIG. 12 is a schematic side view of another constitution of the electrical insulator 99 and the pyroelectric detectors 101 through 103.

The preferred embodiment shown in FIG. 12 allows the electrical insulator 99 to dispense with electrodes and makes up those pyroelectric detectors 101 through 103 using the integrated pyroelectric detector 100 alone. In this preferred embodiment, electrode 100E at one surface of the integrated pyroelectric detector 100 contacts with the electrical insulator 99, whereas those electrodes on the other surface are split into 3 parts including E1, E2 and E3 in order that each of these electrodes E1, E2 and E3 can deal with 3 pyroelectric detectors 101 through 103 respectively. In conjunction with the constitution shown in FIG. 12, using photolithographic means for example, three of these pyroelectric detectors 101 through 103 can simultaneously be formed in order to eventually achieve homogeneous physical characteristic of pyroelectric detectors and save the number of manufacturing processes.

It should be noted that the constitution of the pyroelectric infrared sensor 20 of the second invention other than that which is already cited in reference to the first embodiment is identical to that of the pyroelectric infrared sensor 20 related to the invention. The constitution and functional operation of the circuit for processing the first and second signals extracted from pyroelectric infrared sensor 20 of the second embodiment is the same as those of the first embodiment which are shown in FIGS. 7 and 8.

Next, the actual result of observing varied signals output from the pyroelectric infrared sensor 20 relative to variable atmospheric temperature is analyzed below.

Figure 13:
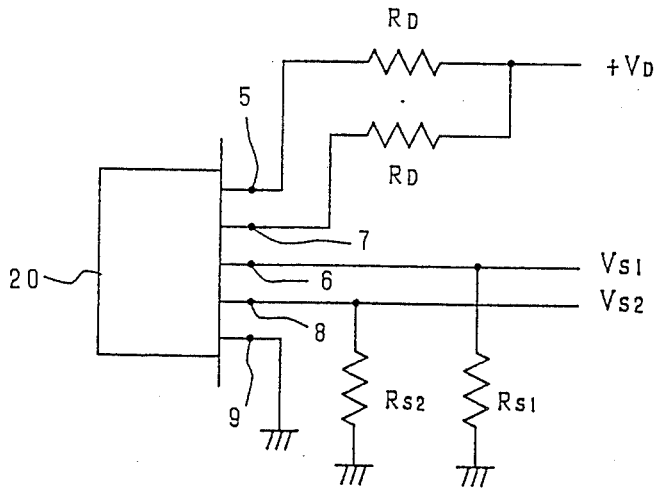
FIG. 13 is a simplified circuit diagram denoting the electrical connections for measuring voltages outputted from the pyroelectric infrared sensor of the invention.

FIG. 13 is a circuit diagram denoting the electrical connections for measuring voltages output from the pyroelectric infrared sensor 20 which is constructed as shown in FIGS. 9 and 10.

Figure 14:
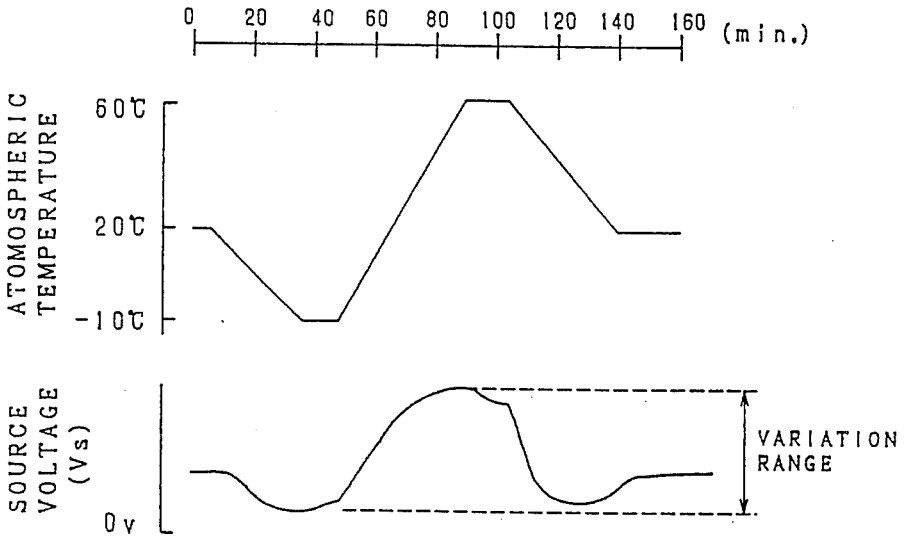
FIG. 14 is a graph denoting the relationship between the output voltage from the electrical connections shown in FIG. 18 and atmospheric temperature.

FIG. 14 denotes the result of observing the source voltages Vs1 and Vs2 (those voltages on both sides of Rs) of FETs **3*b* and 4*b* when varying atmospheric temperature surrounding pyroelectric infrared sensor 20**.

FIG. 15 is a table denoting the comparative results of measuring the variation range of voltage between a conventional pyroelectric infrared sensor and the pyroelectric infrared sensor 20 embodied by the second embodiment of the intrusion detection system related to the invention.

It is clear from the table shown in FIG. 15 that the variation of the first and second signals are almost equivalent to each other due to varied atmospheric temperature, and yet, compared to the second signal of the conventional pyroelectric infrared sensor, the variation range of the second signal of the pyroelectric infrared sensor related to the invention indicates significant decrease by one-half or one-third.

FIG. 16 is a table denoting the comparative ratio of the output voltages between the conventional pyroelectric infrared sensor and the pyroelectric infrared sensor related to the invention in conjunction with the first and second signals, where the output basis of the first signal is 1.

Note that the voltage V output from a pyroelectric infrared sensor has a relationship which is detected by $V \alpha\ 1/C$, where V is the output voltage and C the electrical capacitance of the pyroelectric detector. However, the above-cited pyroelectric infrared sensor 20 incorporates element 1 which output the first signal and element 2 which outputs the second signal, while these elements 1 and 2 respectively constitute two of the first pyroelectric detector 101 and 102, 103 and 102, in the inverse polarity being opposite from each other. This in turn decreases the electrical capacitance C of pyroelectric detector itself. As a result, the output voltage rises as shown in FIG. 16.

As is clear form the above description, the intrusion detection system related to the invention securely prevents incorrect signals from being generated, thus making it possible for manufacturers as well as users to securely establish the most reliable and stable intrusion detection system without expanding the scope of dimensions of sensor and without being involved in complication of the entire detection system.

Next, a preferred embodiment is described below, in which the intrusion detection system which securely informs store employees of the entering visitors by correctly identifying movements of incoming visitors after correctly detecting the movement of any visitor who is entering and leaving the store.

Figure 17:
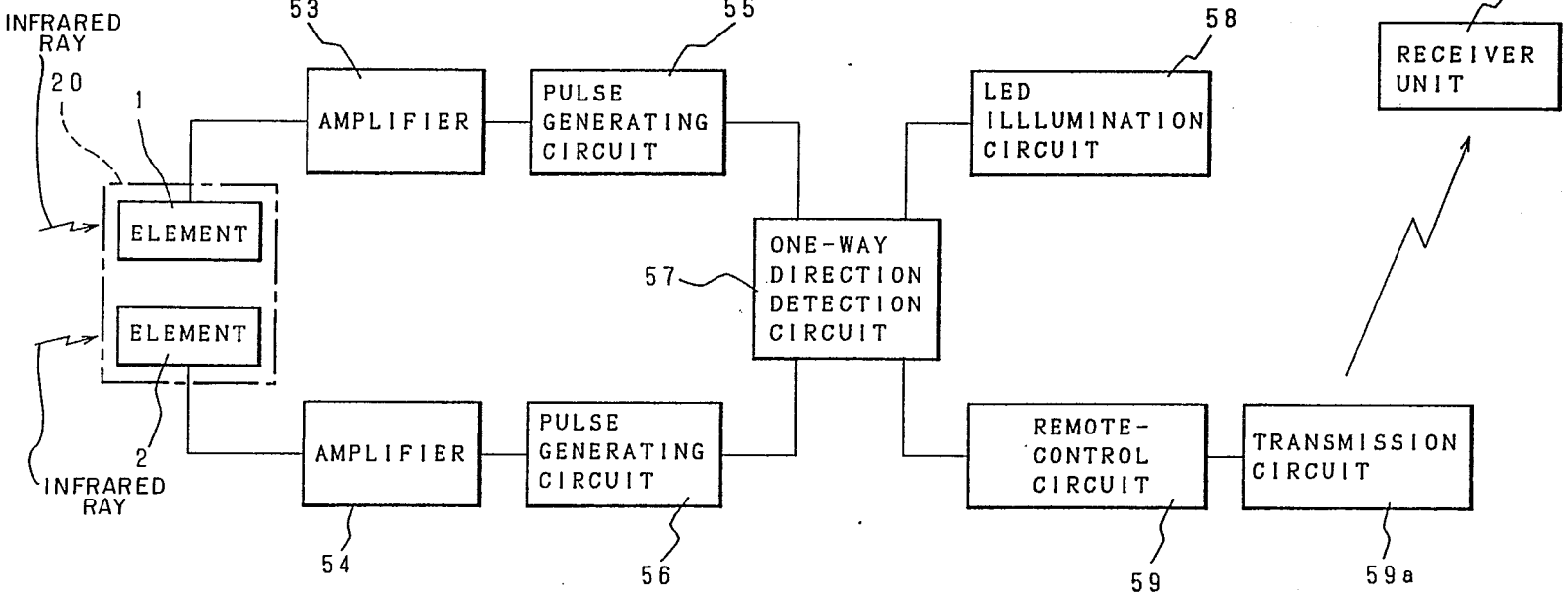
FIG. 17 is a block diagram of the signal processing circuit when the intrusion detection system of the invention is used as a visitor announcing system.

FIG. 17 is the schematic circuit block diagram of a preferred embodiment of the intrusion detection system related to the invention, which is provided with the function for identifying the direction of the incoming visitors and informing store employees of the entering movement of the visitors in the specific one-way direction.

This intrusion detection system shown in FIG. 17 incorporates the following: the first and second elements 1 and 2 which respectively detect infrared rays radiated from the human body; first and second amplifiers 53 and 54 which amplify the first and second signals generated by the first and second elements 1 and 2 respectively; first and second pulse-generation circuits 55 and 56 which generate the first and second pulse signals in response the detected signals by converting the detected signals amplified by amplifiers 53 and 54 into pulses signals respectively; a one-way direction detection circuit 57 which, on receipt of pulse signals from the first and second pulse generating circuits 55 and 56, first identifies the sequential order of detect signals generated by those elements 1 and 2, and then detects the movement of the human body to be detected before eventually activating operations of an LED illumination circuit 58 and a remote-control circuit 59 in the event the human body moves in the predetermined direction; the LED illumination circuit 58 which illuminates an LED for a predetermined duration for warning store employees in response to the signal generated by the one-way direction detection circuit 57 only when the human body moves in the predetermined direction; the remote-control circuit 59 which first receives signals output from the one-way direction detection circuit 57 and then transmits driving signal to a receiver unit **59*b* through a transmission circuit 59*a*; and the receiver unit 59*b* which, on receipt of the driving signal from the remote-control circuit 59**, generates rhythmical advising sound or synthesized vocal message such as "welcome your visit to us" for example.

Figure 18:
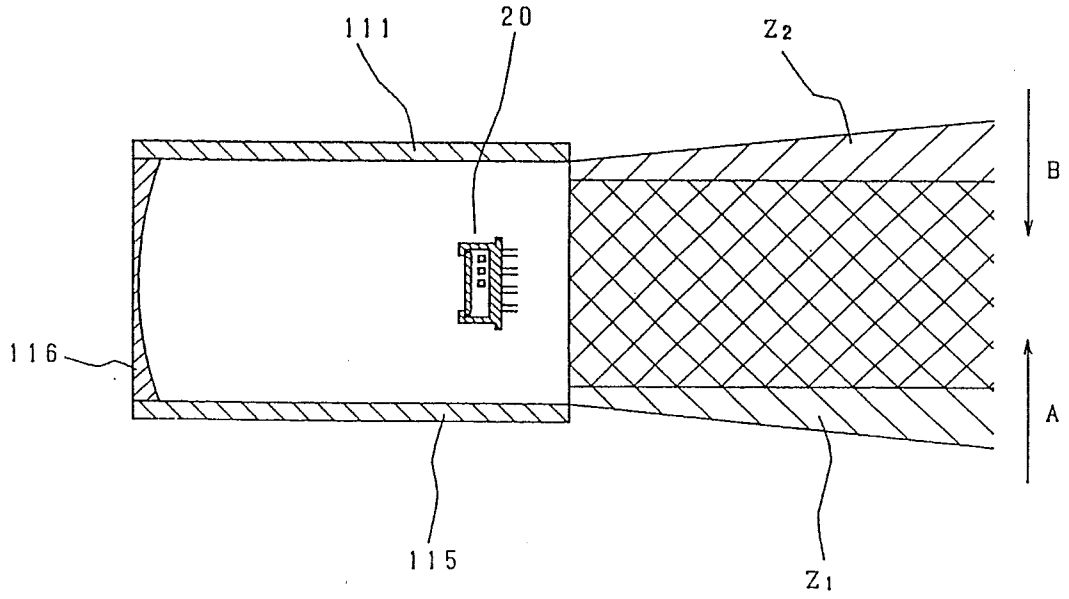
FIG. 18 is a schematic diagram denoting the constitution of the casing for housing the pyroelectric infrared sensor and the detection range thereof.

Note that the pyroelectric infrared sensor 20 uses the sensor unit described above, while this pyroelectric infrared sensor 20 is housed in the internal space of a body tube 115 so that the detection unit 111 can be constituted (FIG. 18).

As shown in FIG. 18, a concave mirror 116 condensing infrared rays is installed on the internal back surface of the body tube 115, while the pyroelectric infrared sensor 20 is installed at the focusing point of the concave mirror 116. In conjunction with detector unit 111, a detection range (visual field) of the first element 1 is denoted by the shadow line $Z_1$ (hereinafter called the visual field $Z_1$). The center line of the visual field $Z_1$ slightly inclines itself to one direction (in FIG. 18, the direction of arrow B) from the center line of the body tube 115. Next, the detection range (visual field) of the second element 2 is denoted by the shadow line $Z_2$ (hereinafter called the visual field $Z_2$). The center line of the visual field $Z_2$ slightly inclines itself to an arrowed direction A being opposite from the center line of the body tube 116.

When the human body moves in the direction of arrow A of the detector unit 111, first, he enters into the visual field $Z_1$, and then, he is detected by the first element 1. When he enters into the visual field $Z_2$, then he is detected by the second element 2.

Figure 19:
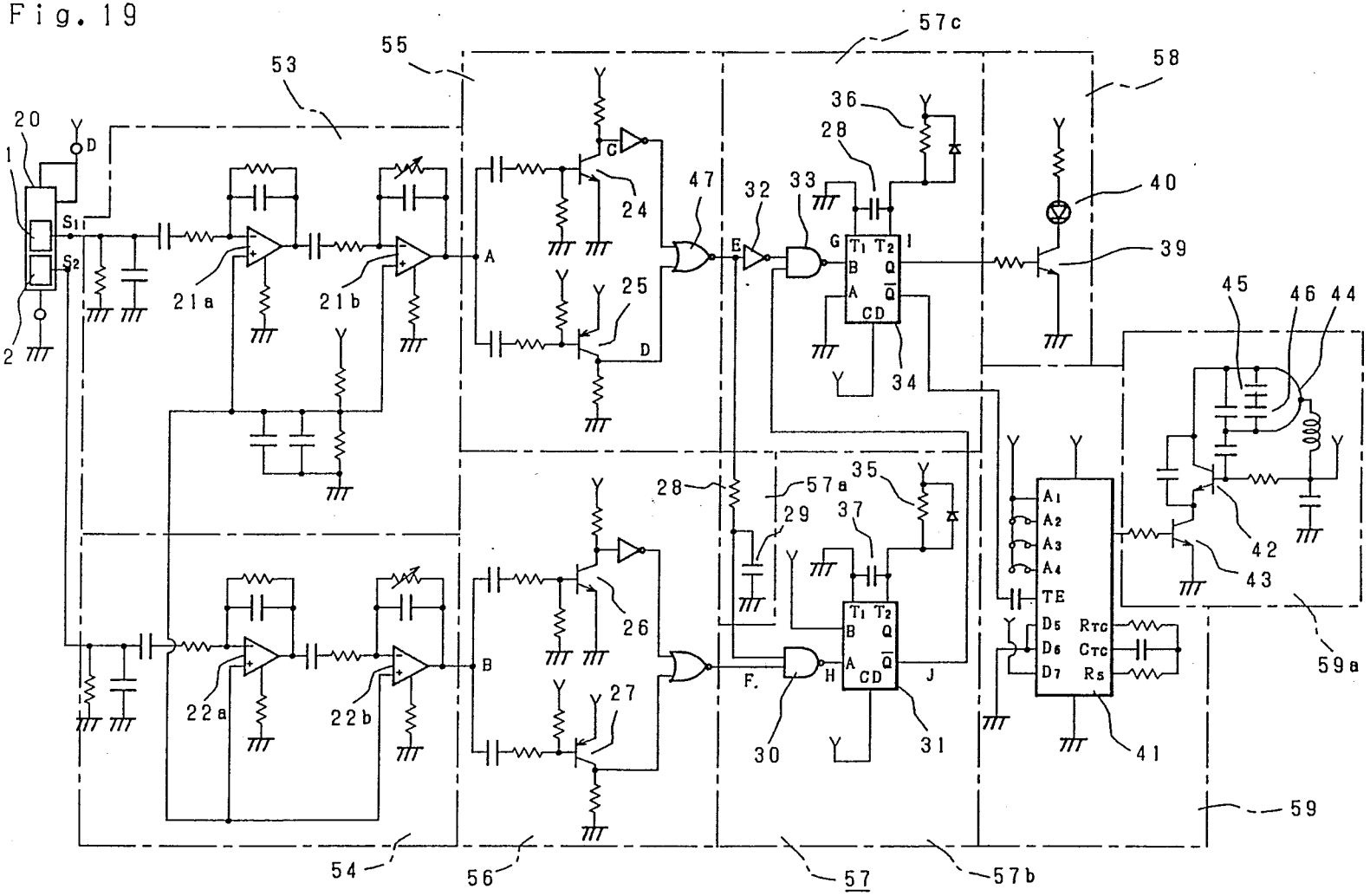
FIG. 19 is a detailed circuit diagram of the signal processing circuit shown in FIG. 17.

FIG. 19 is a detailed circuit diagram of the simplified circuit diagram shown in FIG. 17 except for the receiver unit **59*b***.

The first and second amplifying circuits 53 and 54 are composed of operation amplifiers **21*a*, 21*b* and 22*a*, 22*b*, which, after amplifying the first and second signals generated by the first and second elements 1 and 2**, deliver these signals to terminals A and B respectively.

The first and second pulse-generating circuits 55 and 56 are composed of transistors 24, 25 and 26, 27 respectively, which, on receiept of the first and second signals from the terminals A and B, generate the first and second pulse signals respectively.

The one-way direction detection circuit 57 is composed of a delay circuit **57*a*, an inhibition circuit 57*b*, and a detection signal generating circuit 57*c*. The delay circuit 57*a* is composed of a resistor 28 and a capacitor 29, which causes the first pulse signal delivered to the point E to delay it for a predetermined duration (for example 10 milliseconds) before transmitting it to the inhibition circuit 57*b*. The inhibition circuit 57*b* is composed of the following: NAND gate 30 which is connected to a first pulse generating circuit 55 via the delay circuit 57*a* and also being connected to a second pulse generating circuit 56 and monostable multivibrator 31 which outputs an inhibition signal on receipt of an inhibition pulse output from NAND gate 30 and is retriggerable. The detection signal generating circuit 57*c* is composed of NAND gate 33 which receives the first pulse signal through the inverter 32 and also receives an inhibtion signal and another monostable multivibrator 34 which, on receipt of a detection pulse from NAND gate 33**, outputs a detection signal and is retriggerable.

Figure 21:
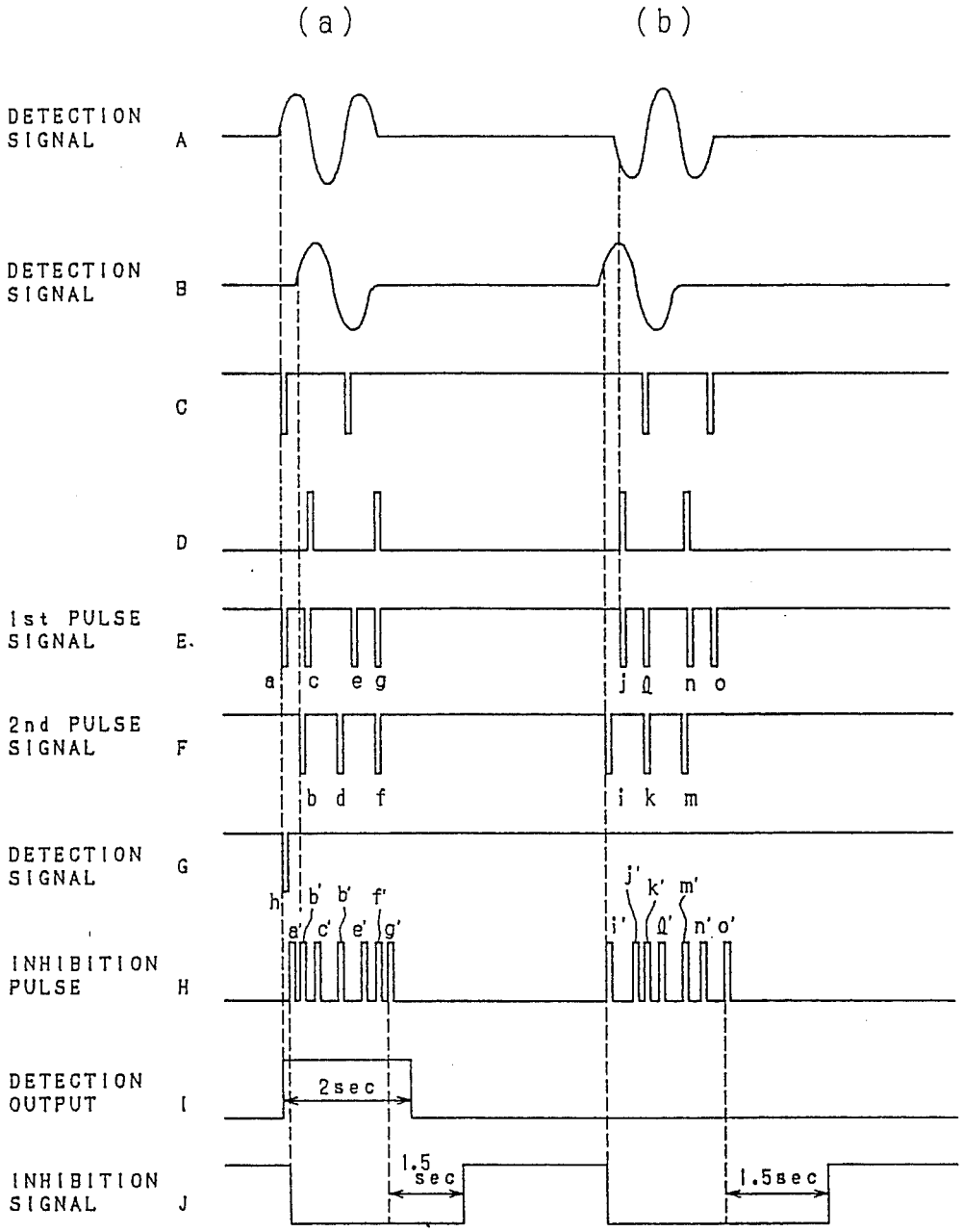
FIG. 21 is a chart of waveforms representing functional operations of the circuit shown in FIG. 19.

The duration of the one-shot pulse output from these monostable multivibrators 31 and 34 is determined by resistors 35 and 36 and capacitors 37 and 38 being connected to terminals $T_1$ and $T_2$ thereof. In this embodiment, specifically, monostable multivibrator 31 provides about 1.5 seconds of one-shot pulse duration, whereas the other monostable multivbrator 34 provides about 2 seconds of one-shot pulse duration, respectively. FIG. 21 is the truth value table of these monostable multivibrators 31 and 34.

The LED illumination circuit 58 is composed of a transistor 39 which becomes conductive on receipt of a signal from monostable multivibrator 34 of the detection signal generating circuit **57*c* and the LED 40 driven by the transistor 39. The remote-control circuit 59 is provided with the remote-control signal generating IC 41, while the transmission circuit 59*a* is composed of transistors 42 and 43, a resonator 44, and resonance capacitors 45 and 46**.

Referring now to FIG. 21 denoting waveforms at points A through J, operations of the circuits shown in FIG. 19 are described below.

FIG. 21(*a*) denotes a variety of signal waveforms in conjunction with the movement of a human body who has entered into the visual field $Z_1$ and then $Z_2$ after proceeding in the arrowed direction A in front of pyroelectric infrared sensor 20. In this case, since infrared rays radiated from the human body are sequentially incident upon the first and second elements 1 and 2, waveforms of detection signals appearing at the output terminals A and B of the first and second amplifying circuits 53 and 54 cause the waveform at the point B to slightly delay itself as shown in FIG. 21(*a*). When the signal waveform at the point A rises, the transistor 24 turns ON, while another transistor 25 turns ON when the signal waveform at the point A falls. This causes pulses generated at points C and D shown in FIG. 21(*a*). By causing these pulses to pass through a NOR gate 47, the first pulse signal shown in FIG. 21(*a*)E is generated at the output terminal E of the first pulse generating circuit 55. Likewise, the second pulse signal shown in FIG. 21(*a*)F is generated at an output terminal F of the second pulse-generation circuit 56. Before generating these pulse signals, first, the initial pulse a of the first pulse signal is input into the one-way direction detection circuit 57. Simultaneously, since the inhibition signal input to NAND gate 33 remains at high level, down-oriented a detection pulse h which is downward is generated in the output signal from the NAND gate 33. Generation of the detection pulse h which is downward inverts monostable multivibrator 34, thus causing the outgoing detection signal appearing at an terminal Q of this monostable multivibrator 34 to remain at high level for a duration of 2 seconds. In thee meantime, the LED illumination circuit 58 is activated to light up the LED 40, thus announcing the presence of a visitor or an unwanted intruder who proceeds in the direction of the arrow A. Simultaneously, the remote control circuit 59 connected to terminal $\overline{Q}$ of monostable multivibrator 34 is activated to transmit the driving signal to the receiver unit 59*b* via the transmission circuit 59*a*. On receipt of the driving signal, the receiver unit 59*b* generated rhythmical advising sound to announce to the store employees or family of the presence of a visitor or an unwanted intruder.

On the other hand, a pulse a′ delayed by the delay circuit 57*a* shown in FIG. 21(*a*)H is generated in, the output, in which the inhibition pulse appears, of the NAND gate 30, thus causing monostable multivibrator 31 to invert its output and the inhibition signal to turn to a low level. Then, monostable multivibrator 31 is retriggered by successive inhibition pulses b′ through g′ which are successively input into it, and thus, the inhibition signal remains at a low level and returns itself to high level 1:5 seconds after generation of the last pulse g′. Even if the first and second pulse signals were generated, no detection pulse is generated while the inhibition signal still remains low level. Consequently, even if an intruder loiters in front of the pyroelectric infrared sensor 20 and detection signals were continuously generated, only the first detection pulse is generated to securely prevent the pyroelectric infrared sensor 20 from incorrectly generating repeated alarms by delivering a number of detection pulses.

On the other hand, FIG. 21(*b*) denotes the case in which the human body proceeds in the direction of arrow B, where he first enters into the visual field $Z_2$ and then enters into the visual field $Z_1$. In this case, infrared rays radiated from the human body are sequentially incident upon the second element 2 and the first element 1, and as a result, point A of the detection signal waveform delays as shown in FIG. 21(*b*). Consequently, pulse j of the first pulse signal delivered to the direction detection circuit 57 is later than the pulse j of the second pulse signal. This causes pulse i to invert monostable multivibrator 31 before receiving pulse j and the inhibition signal to go to a low level. Thus, even if pulse j is received after the inhibition signal went to low level, the detection signal output I cannot go to a high level. In other words, no announcement is generated even if the human body proceeds in the direction B.

In addition, another constitution may also be considered by designating only the second pulse signal to make up the inhibition pulse by varying the above-cited circuit constitution. Assume that the human body slowly proceeds in the direction of arrow B where no detective operation can be implemented. First, an intruder enters into the visual field $Z_2$, then, he passes through the portion where the visible field $Z_1$ and $Z_2$ overlap each other, and finally, he enters into the visual field $Z_1$ after leaving the visual field $Z_2$. When he first enters into the visual field $Z_2$, an inhibition pulse is generated so that the inhibition signal goes to a low level. However, while he still stays in the visual field $Z_1$ after passing through the visual fields $Z_1$–$Z_2$ overlapped portion, it is likely that the inhibition signal may return to a high level. If this occurs, the intrusion detection system may incorrectly announce the presence of an intruder in accordance with the detection signal from the first element 1. Generation of a incorrect announcement can be prevented by sufficiently extending the signal output duration of monostable multivibrator 31 which output inhibition signals for a period of 1.5 seconds. However, if the signal output duration were too long, then, the intrusion detection system may not be able to correctly announce the actual presence of the following intruder who moves in the direction of arrow A.

The intrusion detection system related to the invention generates inhibition pulses from the delayed first pulse signal and second pulse signal, and as a result, the detection system is totally free from those malfunctions cited above, thus securely announcing the presence of an unwanted intruder or a visitor who moves in the objective direction.

Figure 22:
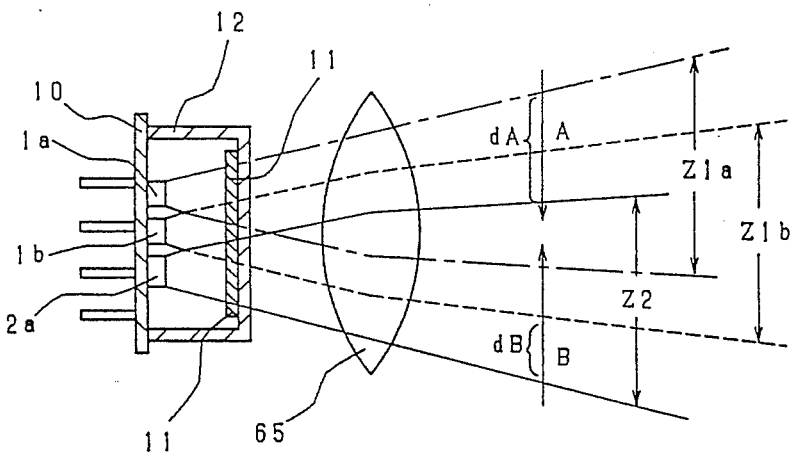
FIG. 22 is a schematic diagram denoting the detectable range of the pyroelectric infrared sensor shown in FIG. 3, FIGS. 23 (*a*), (*b*) and (*c*) are respective charts denoting waveforms output from the pyroelectric infrared sensor shown in FIG. 22.

Note that the intrusion detection system related to the invention uses monostable multivibrators 31 and 34 which are retriggerable. However, the invention also allows use of monostalbe multivibrator 34 which is not retriggerable. Duration of the output pulse may optionally be determined Next, another preferred embodiment of the pyroelectric infraread sensor 20 related to the invention is described below, which is capable of more accurately detecting the direction of the movement of the human body to be detected. FIG. 22 shows the construction of FIG. 18 in which the concave mirror 116 is replaced by a convex lens 65 functioning equivalent to the concave mirror 116.

Figure 23A:
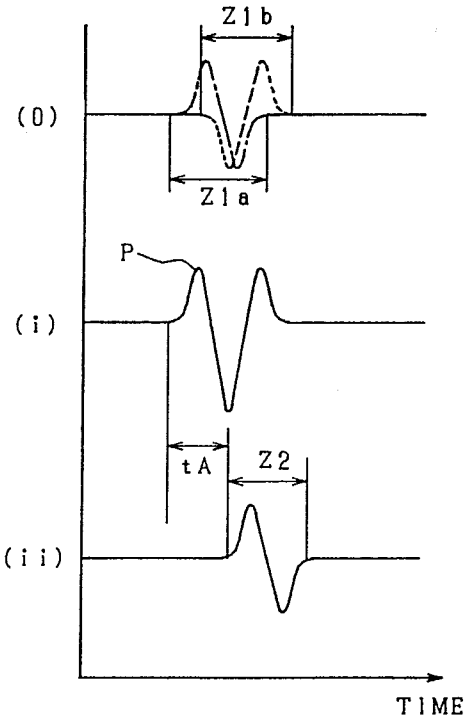
Figure 23B:
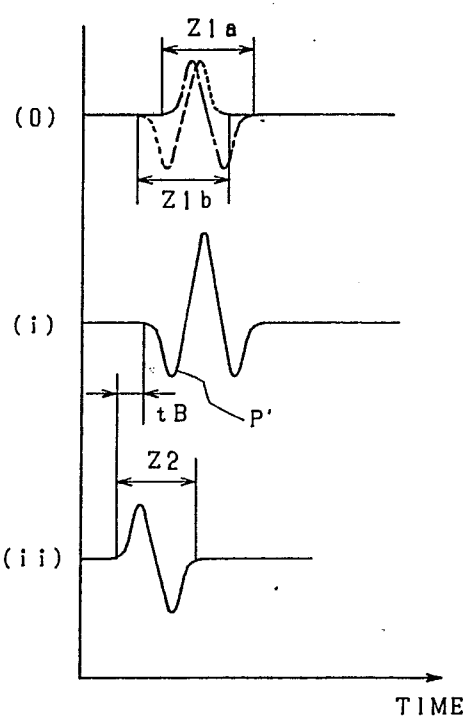
Figure 23C:
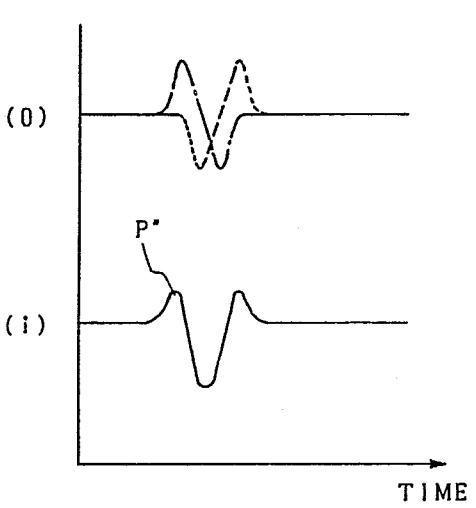

Referring to FIG. 22, assume that each of the pyroelectric detectors 1*a*, 1*b* and 2*a* deals with detection ranges Z1*a*, Z1*b* and Z2, respectively. The human body to be detected moving the direction of an arrow A passes through the detection ranges in order of Z1*a*, Z1*b* and Z2. Then, simultaneous with passage of the human body to be detected, the elements 1 and 2 then generate detection signals shown in FIG. 23(*a*). The element 1 generates a detection signal shown in FIG. 23(*a*) (*i*). This signal is then composited by the signal from the pyroelectric detector 1*a* shown in FIG. 23(*a*) (*o*) (by single-dot and chained line) and the signal (shown by broken line) of the following pyroelectric detector 1*b*. Following the initial detection signal generated by the pyroelectric detector 1*b*, the element 2 then generates another detection signal shown in FIG. 23(*a*) (*ii*). Conversely, when the human body to be detected proceeds in the direction of an arrow B, as shown in FIG. 23(*b*), the element 2 first generates a detection signal shown in FIG. 23(*b*) (*ii*), followed by another detection signal which is generated by the element 1 subsequent to composite of those signals generated by the pyroelectric detector 1*b* and 1*a*, as shown in FIG. 23(*b*) (*i*). Consequently, as mentioned above, the direction of the passage of the human body is detected by comparing the time at which respective pyroelectric elements 1 and 2 had generated detect signals.

Nevertheless, actually, despite quite narrow intervals between each pyroelectric detector of the infrared sensor cited above (where above 0.5 mm of extremely narrow intervals are provided), since a human body to be detected does not radiate infrared rays from a point source, but there are a number of radiating sources in a human body with intensified distribution, and yet, due to adverse effecat of inacurate focus and astigmation taking place with optical members like a convex lens or concave mirror, it may become difficult for the infrared sensor cited above to precisely detect the direction of the passage of the human body.

For example, when the human body to be detected moves in the direction of the arrow A shown in FIG. 22, due to inaccurate focusing effect of the convex lens 65, it is likely that infrared rays may simultaneously enter into a pair of closing adjoining pyroelectric detectors 1*a* and 1*b* of the element 1, and as a result, the timewise difference for causing those pyroelectric detectors 1*a* and 1*b* to generate detection signals may be reduced as shown in FIG. 23(*c* ) (*o*). If this occurs, detection signals from these two pyroelectric detectors 1*a* and 1*b* in dual connection cancel each other, and thus, the detection signal output from the element 1 turns out to be shown in FIG. 23(*c*) (*i*) and its peak P" becomes smaller than the peaks P and P' shown in FIGS. 23(*a*) (*i*) and 23 (*b*) (*i*). This symptom is particularly significant when the human body moves fast in conjunction with the electrical characteristic of pyroelectric elements allowing signals to gradually rise themselves by virtue of a charge which is generated from the moment at which infrared rays enter into those elements. Consequently, low peak P" cannot be extracted as a signal when digitally processing pulse-coded detect signals, and as a result, the infrared sensor itself may not be able to detect the direction of the movement and passage of the human body.

Note that the timewise difference between those detection signals of the elements 1 and 2 is denoted to be $t_A$ in the direction A and $t_B$ is the direction B as shown in FIG. 23, while each of which corresponds to distances $d_A$ and $d_B$ shown in FIG. 22 respectivley. When the timewise difference shown above is present, since the timewise difference between those detection signals cited above is too short when the human body moves in the direaction B, the infrared sensor 20 cited above faces more difficulty to precisely detect the direction of the movment of human body by detection of the timewise difference.

Although these problems can be solved by extending intervals between each pyroelectric detector, it is nevertheless essential for the entire detection system including the infrared sensor 20 itself, convex lens 65 and the rest of components to have enlarged dimensions. This in turn obliges users to provide more space needed for consummating installation of the entire intrusion detection system.

As mentioned above, it is clear that intervals between respective pyroelectric detectors should be extended in order to gain access to more accurate detection of the direction of the movement of the human body using pyroelectric infrared sensor 20. This in turn obliges this sensor 20 to have expanded total dimensions. Now, therefore, a preferred embodiment of the constitution of pyroelectric infrared sensor 20 is introduced below, which securely achieves satisfactory detection effects equivalent to the specific case of extending intervals between respective pyroelectric detectors without actually extending the intervals at all.

Figure 24:
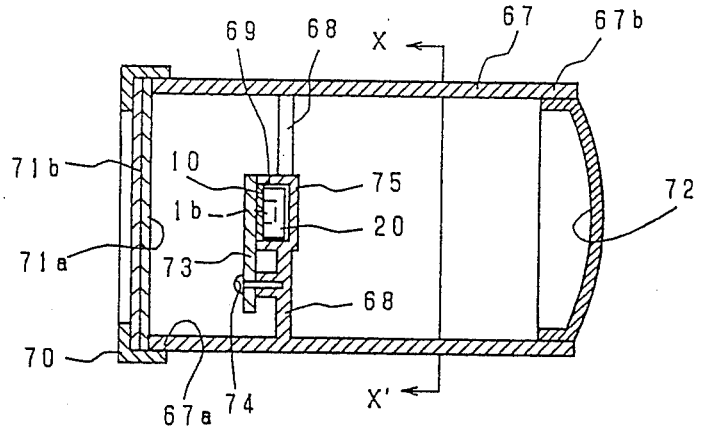
FIG. 24 is a side sectional view of another preferred embodiment of the pyroelectric infrared sensor of the invention.
Figure 25:
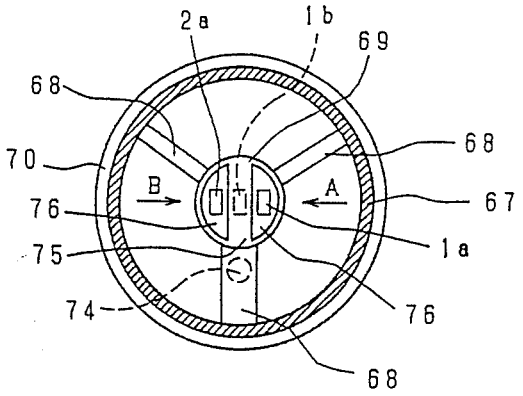
FIG. 25 is a vertical sectional view of the pyroelectric infrared sensor shown in FIG. 24.
Figure 26:
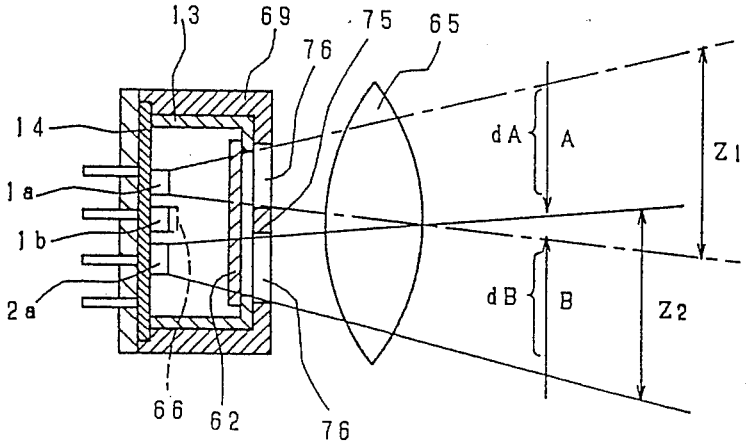
FIG. 26 is a schematic diagram denoting detection range of the pyroelectric infrared sensor shown in FIG. 24, FIGS. 27 (*a*) and (*b*) are respective waveforms of the first and second signals outputted from another preferred embodiment of the pyroelectric infrared sensor shown in FIGS. 24 through 26.

FIG. 24 is a side sectional view of pyroelectric infrared sensor 20. FIG. 25 is a sectional view of the pyroelectric infrared sensor 20 taken on line X through Y'. FIG. 26 is a sectional view of the pyroelectric infrared sensor 20 having the constitution being equivalent to that is shown in FIG. 24.

A body tube 67 incorporates the pyroelectric infrared sensor 20. Three legs 68 shown in FIG. 25 integrally constitute the cylindrical sensor fixing member 69 which is securely installed to the center position. A casing ring 70 is secured to one open end 67*a* of the body tube 67. Brown and white filters 71*a* and 71*b* made from polyethylene resin are respectively secured to the one open end of the body tube 67 with the casing ring 70, while each of these filters 71*a* and 71*b* allows infrared rays emitted from the human body to be detected to permeate themselves into the body tube 70 which externally shields the inner mechanism so that the inner mechanism is invisible. A concave mirror 72 is secured to the other open end 67*b*, which reflects incoming infrared rays from the one open end 67*a* and guides these rays to pyroelectric infrared sensor 20 via brown and white filters 71*a* and 71*b*. The header 10 of pyroelectric infrared sensor 20 is secured to the printed wiring board with lead wires being soldered. An infrared ray permeation filter 62 receiving incident infrared rays is installed so that it faces the convex mirror 72. Pyroelectric infrared sensor 20 is secured to the sensor-fixing member 69 with a screw 74 from the direction where brown and white filters 71*a* and 71*b* are present.

The infrared ray shielding member 75 of the sensor-fixing member 69 being in front of pyroelectric detector 1*b* of the element 2 is integrally formed in the edge portion facing the concave mirror 72. The infrared ray shielding member 75 is in front of and apart from pyroelectric detector 1*b*. As shown in FIG. 25, the lengthy infrared ray shielding member 75 is formed in the vertical direction against directions of the arrows A and B (where the human body passes through) at a specific position close to the axis of infrared rays incident upon pyroelectric detector 1*b*. The infrared ray shielding member 75 shields those infrared rays which radiate from the ray-axis of pyroelectric detector 1*b* and are about to enter into this detector 1*b* when the human body is exactly in front of pyroelectric detector 1*b*. The other pyroelectric element 1*a* and pyroelectric element 2*a* constituting the second element 2 are installed to openings 76 and 76 formed on both sides of the infrared ray shielding member 75.

Next, referring now to FIG. 26 denoting the convex lens 65 replacing the concave mirror 72 and exerting a specific function equivalent to that to the concave mirror 72, functional operation of the preferred embodiment of pyroelectric infrared sensor 20 is described below.

Figure 27A:
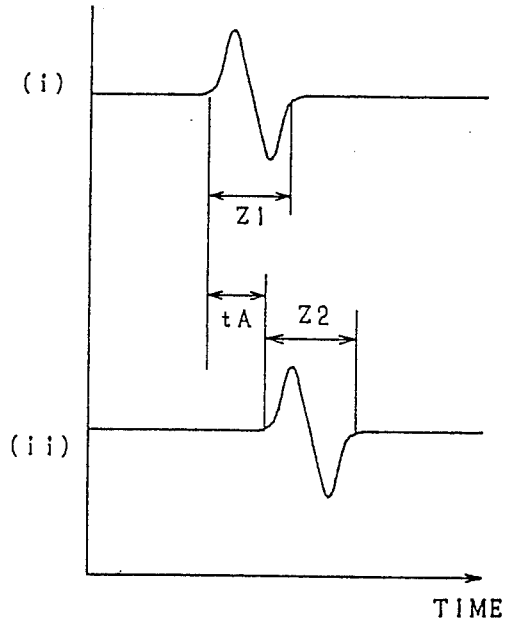
Figure 27B:
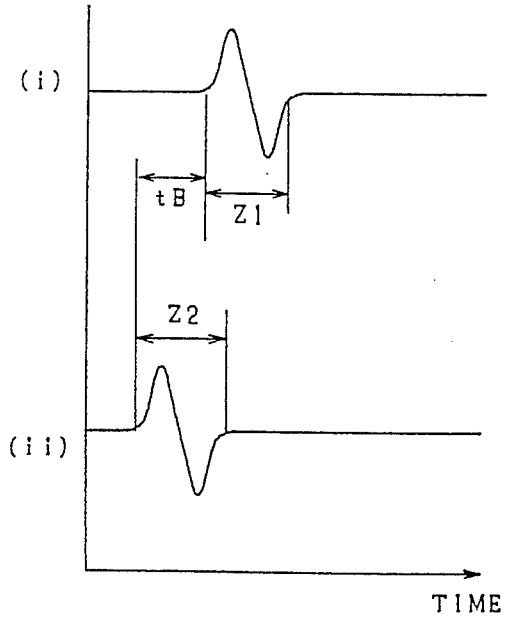

FIG. 27 denotes waveforms of the detection signals generated by the elements 1 and 2 when the human body to be detected moves in the directions of arrow A and B. Since infrared rays which are radiated from the human body are shielded before entering into pyroelectric detector 1*b*, waveform (i) generated by the element 1 has a shape almost being identical to that which is generated by one pyroelectric element which is not dual connected. As a result, the peak P" of the signal waveform shown in FIG. 23(*c*) does not fall itself by mutually offset effect of detection signals outputted from pyroelectric detectors 1*a* and 1*b*. Distance $d_A$ and $d_B$ corresponding to the timewise differences between detection signals output from the elements 1 and 2 are quite sufficient and equal to each other. In other words, the interval between the elements 1 and 2 has substantially been extended. As a result, independent of the directions of arrows A and B denoting the passage of the detected human body, as shown in FIG. 27(*a*) and (*b*) respectively, the timewise difference between $t_A$ and $t_B$ is quite sufficient in causing the elements 1 and 2 to generate detection signals, and thus, this securely allows the detection system to implement very accurate detection of the direction of the movement of the human body.

In order to achieve such satisfactory effects by applying the infrared ray shielding member 75, it is also possible for the detection system to adhere a tape (not shown) for shielding permeation of infrared rays at a portion (matching the infrared ray shielding member 75) in front of the infrared ray permeation filter 62 shown in FIG. 26. Nevertheless, since this simple method cannot stably adhere the tape, and yet, incorrect adhesion of the tape may adversely affect stable performance characteristic of pyroelectric infrared sensor 20 itself. In addition, it raises a certain difficulty in the assembly work, and results in the increased number of working processes and expensive cost as well. On the other hand, the preferred embodiment integrally forms the sensor fixing member 69 supporting the elements 1 and 2 in the body tube 67 with the infrared ray shielding member 75. This is turn allows the assembly work to easily be done at inexpensive cost, and yet, the performance characteristic of the pyroelectric infrared sensor 20 can be held stable.

In addition, as denoted by broken line shown in FIG. 26, there is another consideration to directly adhere the infrared ray shielding tape on the pyroelectric detector 1*b* without adhering it to the infrared ray filter 62. In this case, if the atomspheric brightness grows for example, pyroelectric, detectors 1*a* and 2*a* may respectively generate output signals, and yet, for any reason, if certain timewise difference were generated between these signals, pyroelectric infrared sensor 20 may incorrectly detect the object. Conversely, since the preferred embodiment forms the infrared ray shielding member 75 apart from pyroelectric detector 1*b*, even if the atmospheric brightness grows, infrared rays also enter into pyroelectric detector 1*b* from the openings 76 and 76 out ot the infrared ray shielding member 75 and then generate a detection signal, which is then canceled by another detection signal outputted from pyroelectric detector 1*a*. Consequently, no detection signal can be outputted from the element 1, thus preventing the detection system from incorrectly detecting the direction of the movement of the human body.

Furthermore, there is another consideration to constitute the elements 1 and 2 merely with pyroelectric detectors 1*a* and 2*a* respectively by deleting pyroelectric detector 1*b*. However, if this idea were implemented, then, the element 1 may incorrectly generate detection signal due to variation of infrared rays caused by fluorescent light, or movement of curtain, a or varied temperature surrounding the elements 1 and 2, thus easily causing the detection system to incorrectly detect the object and its movement as well. Conversely, when implementing the preferred embodiment described above, the detecting system does not perform incorrect detection at all, but it securely detects the direction of the movement of the human body to be detected all the time.

Figure 28:
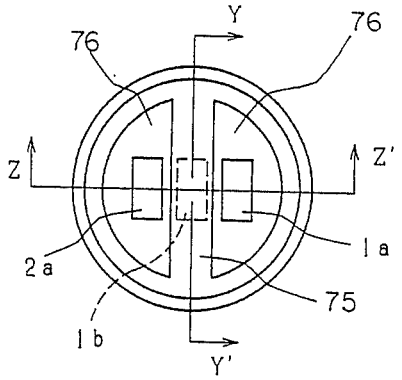
FIG. 28 is a front sectional view of a still further preferred embodiment of the pyroelectric infrared sensor of the invention.
Figure 29:
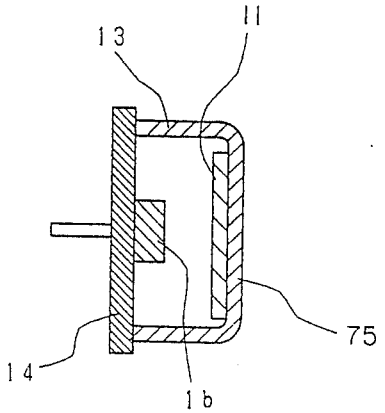
FIG. 29 is a vertical sectional view of the pyroelectric infrared sensor shown in FIG. 28.
Figure 30:
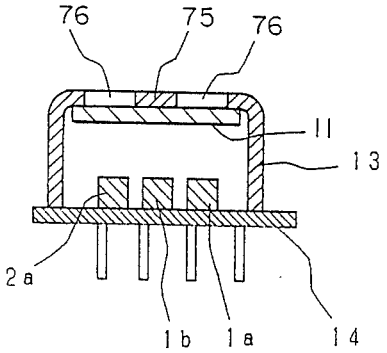
FIG. 30 is a horizontal sectional view of the pyroelectric infrared sensor shown in FIG. 28.

FIGS. 28 through 30 respectively denote a still further preferred embodiment of pyroelectric infrared sensor 20 related to the invention. The infrared ray shielding member 75 is integrally formed with metallic cover 63 which constitutes pyroelectric infrared sensor 20. Compared to the preferred embodiment shown in FIGS. 24 through 26 in which the infrared ray shielding member 75 is installed to the sensor fixing member 69 of the body tube 69 incorporating pyroelectric infrared sensor 20, the constitution shown in FIGS. 28 through 30 minimizes uneven performances of the sensor itself. The preferred embodiment shown in FIGS. 24 through 26 forms the infrared ray shielding member 75 by allowing the body tube 67 supporting the sensor 20 to also hold this member 75. However, the preferred embodiment shown in FIGS. 28 through 30 integrally forms the infrared ray shielding member 75 with the metallic cover 63 of pyroelectric infrared sensor 20 which directly supports the elements 1 and 2.

The foregoing description has solely referred to the constitution in which one-way direction detection is executed by means of the element 1 composed of a pair of dual-connected pyroelectric detectors 1*a* and 1*b* and the element 2 composed of pyroelectric detector 2*a* alone. It should be understood, however, that the pyroelectric infrared sensor related to the invention is also applicalbe to the needs of implementing bi-directional detection of the object to be detected using a pair of elements which are dual-connected by two pyroelectric detectors as well.

As described above, the pyroelectric infrared sensor of the above preferred embodiment forms infrared ray shielding means in front of and apart from one of two dual-connected pyroelectric detectors. This allows the pyroelectric infrared sensor related to the ivention to securely detect the direction of the movement of the human body to be detected, thus preventing the system from incorrectly detecting the objects. Furthermore, since the above preferred embodiment integrally forms the infrared ray shielding member with the sensor supporting member, assemble work can easily be done, and yet, the performance of pyroelectric infrared sensor rarely becomes inconsistent. As result, the invention provides a high quality infrared sensor ensuring constantly stable performance characteristic.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An intrusion detection system comprising:

an infrared sensor in which three pyroelectric detectors, each having a pair of electrodes, are disposed in line with an interval and an adjoining two of said three pyroelectric detectors are electrically connected to cancel electrical charges generated by each said pyroelectric detector, said sensor outputting a first signal and a second signal on the basis of outputs of said adjoining two and the remaining one of said three pyroelectric detectors, respectively; and an intrusion detector which detects an infrared ray radiating object based on said first and second signals outputted from said infrared sensor.

2. An intrusion detection system as set forth in claim 1, wherein said infrared sensor outputs said first signal based on the output from a node of said two adjoining pyroelectric sensor, said sensors being connected in parallel and outputs said second signal based on the output from the remaining one of said detectors.

3. An intrusion detection system as set forth in claim 2, wherein said intrusion detector detects the moving direction of the infrared ray radiating object by the generating order of said first and second signals.

4. An intrusion detection system as set forth in claim 2, wherein said intrusion detector is provided with:

first and second pulse generating circuits which generate first and second pulse signals corresponding to said first and second signals respectively;

a one-way direction detection circuit having a delay cirucit which delays said first pulse signal for a predetermined duration, an inhibition circuit which is retriggerable and outputs inhibition signals based on the delayed signal of said first pulse signal delivered from said delay circuit and said second pulse signal, and a detection signal generating circuit which detects the movement of the infrared ray radiating object in the predetermined one-way direction by outputting a detection signal only when receipt of said first pulse signal precedes said inhibition signal supplied from said inhibition circuit.

5. An intrusion detection system as set forth in claim 2, wherein said infrared sensor is provided with an infrared ray shielding member disposed in front of and apart from the detection direction of the pyroelectric detector disposed in the center of said three pyroelectric detectors.

6. An intrusion detection system as set forth in claim 2, wherein said infrared sensor is provided with a supporting means for said three pyroelectric detectors, and an infrared ray shielding member being integrally formed with said supporting means in front of and apart from the detection direction of the pyroelectric detector disposed at the center of said three pyroelectric detectors.

7. An intrusion detection system comprising:

an infrared sensor having three pyroelectric detectors including a center pyroelectric detector and first and second adjoining pyroelectric detectors disposed on opposite sides of said center pyroelectric detector, each having a pair of electrodes, said pyroelectric detectors being disposed in line with an interval and an adjoining two of said three pyroelectric detectors are electrically connected to cancel electrical charges generated by each said pyroelectric detector, wherein said infrared sensor outputs a first signal based on an output from the center and the first adjoining pyroelectric detector, said center and first adjoining pyroelectric detectors being connected in series, and wherein said infrared sensor also outputs a second signal based on an output from the center and the second adjoining pyroelectric detector, said center and second adjoining pyroelectric detectors being connected to each other in series, and an intrusion detector which detects an infrared ray radiating object based on said first and secaond signals outputted from said infrared sensor.

8. An intrusion detection system as set forth in claim 7, wherein said intrusion detector detects the moving direction of the infrared ray radiating object by the generating order of said first and second signals.

9. An intrusion detection system as set forth in claim 7, wherein said intrusion detector is provided with;

first and second pulse generating circuits which generate first and second pulse signals corresponding to said first and second signals respectively;

a one-way direction detection circuit having a delay circuit which delays said first pulse signal for a predetermined duration, an inhibition circuit which is retriggerable and outputs inhibition signals based on the delayed signal of said first pulse signal delivered from said delay circuit and said second pulse signal, and a detection signal generating circuit which detects the movment of the infrared ray radiating object in the predetermined one-way direction by outputting a detection signal only when receipt of said first pulse signal precedes said inhibition signal supplied from said inhibition circuit.

10. An intrusion detection system as set forth in claim 7, wherein said infrared sensor is provided with an infrared ray shielding member disposed in front of and apart from the detection direction of the pyroelectric detector disposed at the center of said three pyroelectric detectors.

11. an intrusion detection system as set forth in claim 7, wherein said infrared sensor is provided with a supporting means for said three pyroelectric detectors, and a infrared ray shielding member being integrally formed with said supporting means in front of and apart form the detection direction of the center pyroelectric detector.

* * * * *